US006855040B2

(12) United States Patent
Huber

(10) Patent No.: US 6,855,040 B2
(45) **Date of Patent: *Feb. 15, 2005**

(54) ERGONOMICALLY FRIENDLY ORBITAL SANDER CONSTRUCTION

(75) Inventor: Paul W. Huber, Lancaster, NY (US)

(73) Assignee: Hao Chien Chao, South Pasadena, CA (US)

( * ) Notice: Subject to any disclaimer, the term of this patent is extended or adjusted under 35 U.S.C. 154(b) by 1 day.

This patent is subject to a terminal disclaimer.

(21) Appl. No.: 10/373,169

(22) Filed: Feb. 24, 2003

(65) Prior Publication Data

US 2003/0129934 A1 Jul. 10, 2003

Related U.S. Application Data

(60) Division of application No. 09/587,711, filed on Jun. 5, 2000, now abandoned, which is a continuation-in-part of application No. 09/408,192, filed on Sep. 29, 1999, now Pat. No. 6,257,970, which is a continuation-in-part of application No. 08/787,873, filed on Jan. 23, 1997, now Pat. No. 6,004,197.

(51) Int. Cl.[7] ..... B24B 23/04
(52) U.S. Cl. ..... 451/357; 451/344
(58) Field of Search ..... 451/456, 357, 451/359, 344, 353

(56) References Cited

U.S. PATENT DOCUMENTS 2,114,966 A 4/1938 Myers
3,673,744 A 7/1972 Oimoen
3,785,092 A 1/1974 Hutchins (List continued on next page.)

FOREIGN PATENT DOCUMENTS

TW 345521 3/1988

OTHER PUBLICATIONS

The Aro Corporation, Operator's Manual, Random Orbital Sander, Oct. 16, 1990—4 pages.
Black & Decker—Sheet Finishing Sander—May 1998—1 page.
SP Air—Shinano Pneumatic Tools—Date unknown—pp. 46, 48.
Compact—812A4D, 803A4D, 814B—Date unknown—pp. 19, 20, 25.

*Primary Examiner*—Eileen P. Morgan
(74) *Attorney, Agent, or Firm*—Joseph P. Gastel; Patricia M. Costanzo

(57) ABSTRACT

A random orbital sander including a housing, a motor having a vertical axis in the housing, a pad coupled to the motor, a face on the pad extending substantially perpendicularly to the vertical axis, a shroud surrounding the pad, an opening in the shroud, and a dust discharge tube having an inner end in communication with the opening and an outer end on the dust discharge tube end extending at an acute angle to the face of the pad. An orbital sander wherein the pad is supported from the sander housing by columnar units located on opposite sides of the motor. A bore in the motor shaft conducts compressed air through the chamber housing the bearings which support the spindle which mounts the pad.

41 Claims, 22 Drawing Sheets

U.S. PATENT DOCUMENTS

| | | | | |
|---|---|---|---|---|
| 3,793,781 | A | | 2/1974 | Hutchins |
| 3,970,110 | A | | 7/1976 | Schaedler et al. |
| 4,071,981 | A | | 2/1978 | Champayne |
| 4,268,233 | A | | 5/1981 | Fernstrom |
| D269,845 | S | | 7/1983 | Hutchins |
| 4,414,781 | A | | 11/1983 | Overy et al. |
| 4,467,565 | A | | 8/1984 | Wallace et al. |
| 4,531,329 | A | | 7/1985 | Huber |
| 4,624,078 | A | | 11/1986 | Van Rijen et al. |
| 4,660,329 | A | | 4/1987 | Hutchins |
| 4,671,019 | A | | 6/1987 | Hutchins |
| 4,854,085 | A | | 8/1989 | Huber |
| 4,879,847 | A | | 11/1989 | Butzen et al. |
| D314,125 | S | | 1/1991 | Ogawa et al. |
| 5,040,340 | A | | 8/1991 | Bischof et al. |
| 5,105,585 | A | | 4/1992 | Hampl et al. |
| D326,398 | S | | 5/1992 | Fushiya et al. |
| 5,125,190 | A | | 6/1992 | Buser et al. |
| D332,734 | S | | 1/1993 | Fushiya et al. |
| D334,126 | S | | 3/1993 | Huber et al. |
| 5,228,244 | A | | 7/1993 | Chu |
| D347,561 | S | | 6/1994 | Huber et al. |
| 5,319,888 | A | | 6/1994 | Huber et al. |
| D350,266 | S | | 9/1994 | Huber et al. |
| D350,886 | S | | 9/1994 | Huber et al. |
| 5,411,386 | A | | 5/1995 | Huber et al. |
| 5,531,639 | A | | 7/1996 | Catalfamo |
| 5,536,199 | A | | 7/1996 | Urakami |
| 5,538,040 | A | | 7/1996 | Huber et al. |
| 5,558,569 | A | | 9/1996 | Lee |
| 5,595,530 | A | | 1/1997 | Heidelberger |
| 5,597,348 | A | | 1/1997 | Hutchins |
| 5,709,595 | A | | 1/1998 | Bergner et al. |
| 5,713,785 | A | | 2/1998 | Nishio |
| 5,791,979 | A | | 8/1998 | Duncan et al. |
| 5,885,146 | A | | 3/1999 | Cockburn |
| 6,447,383 | B2 | * | 9/2002 | Oda et al. ..... 451/357 |
| 6,485,360 | B1 | * | 11/2002 | Hutchins ..... 451/357 |
| 6,506,107 | B2 | * | 1/2003 | Clowers et al. ..... 451/359 |

* cited by examiner 10
11
12
13
15
17
105
106
108
87
80
90
3
1A 10
11
12
13
14
15
17
22
71
81
87
80
93
94
95
105
106
107
108
110
2A
3
a
b

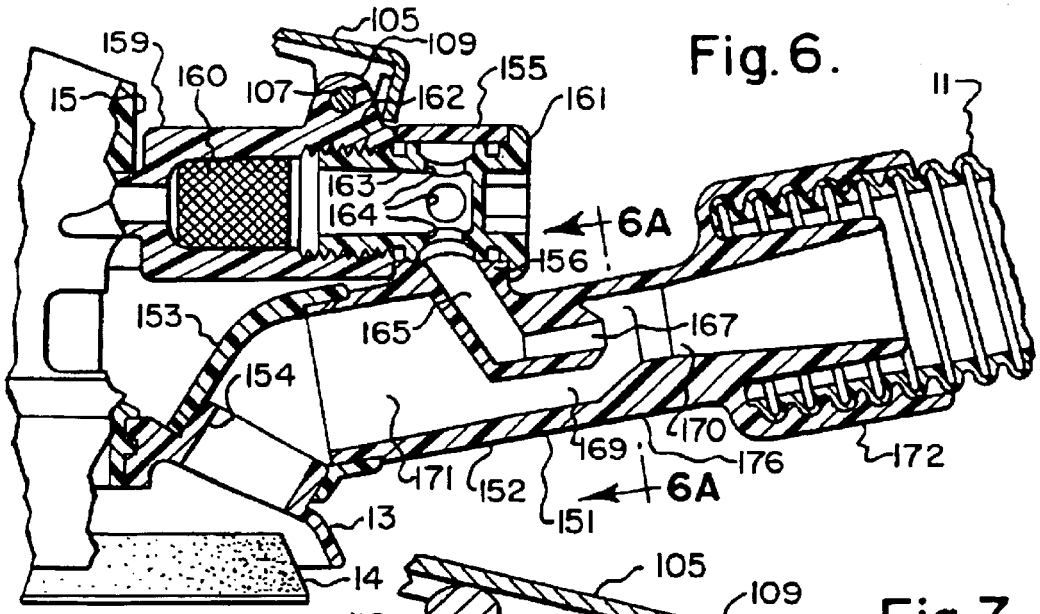
Fig. 6.
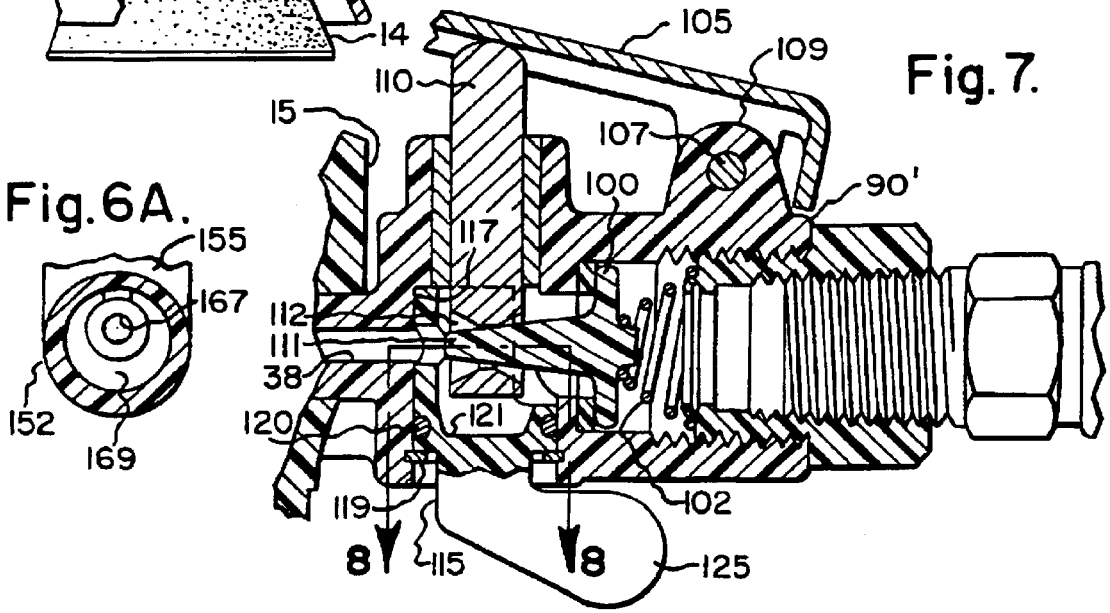
Fig. 7.
Fig. 6A.
Fig. 8.
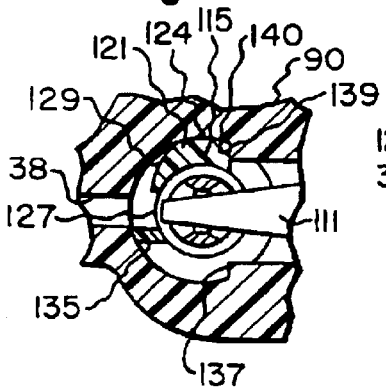
Fig. 9.
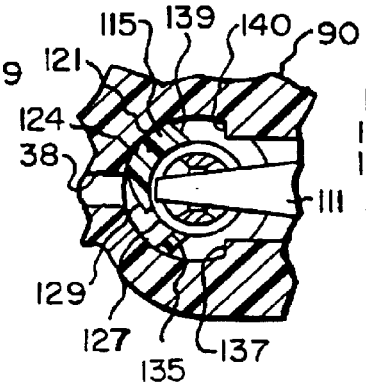
Fig. 10.
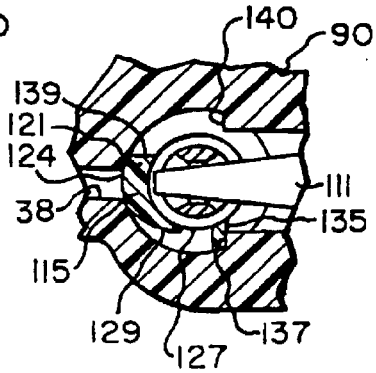

Fig. 11.
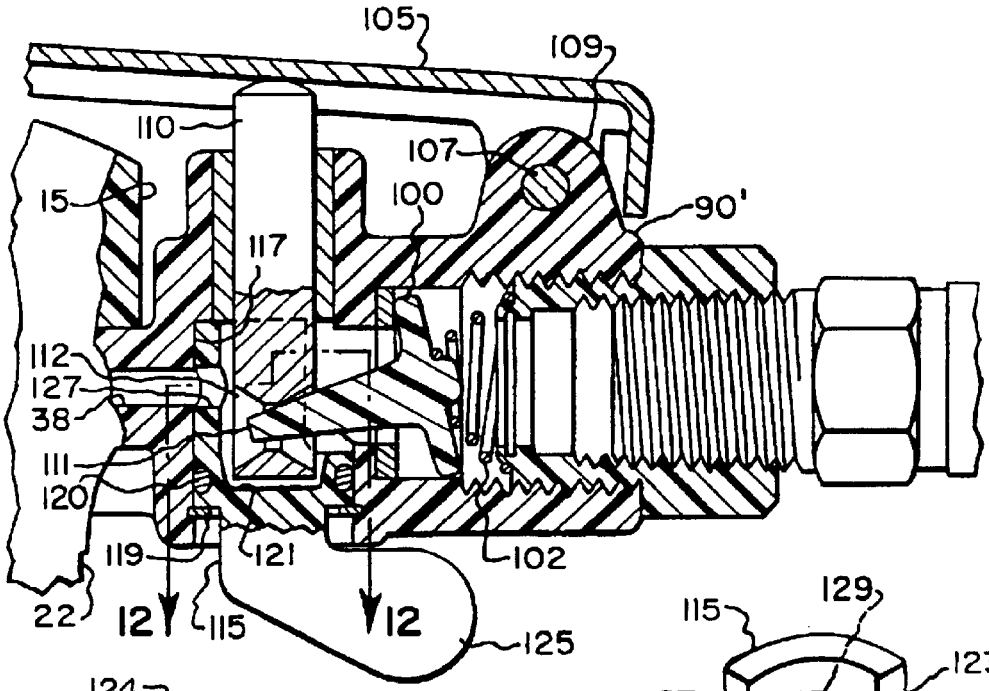
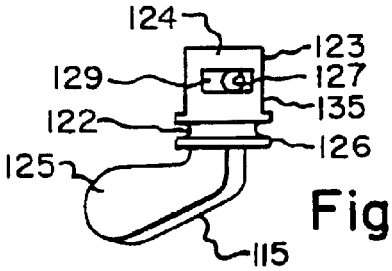
Fig. 11B.
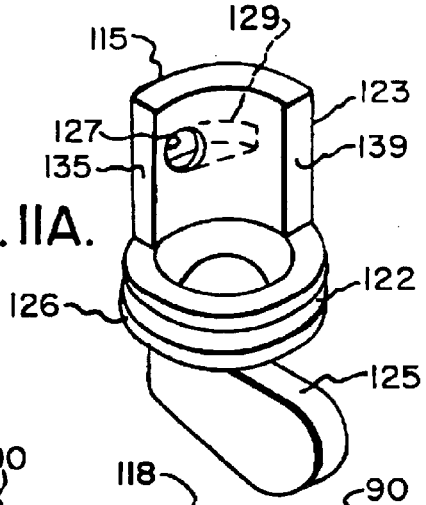
Fig. 11A.
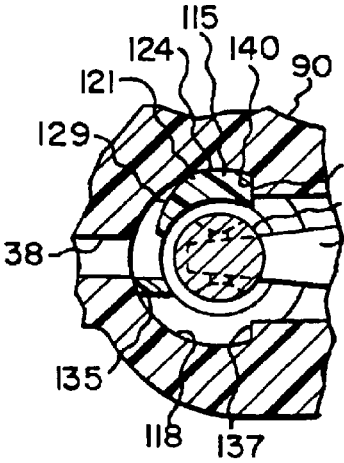
Fig. 12.
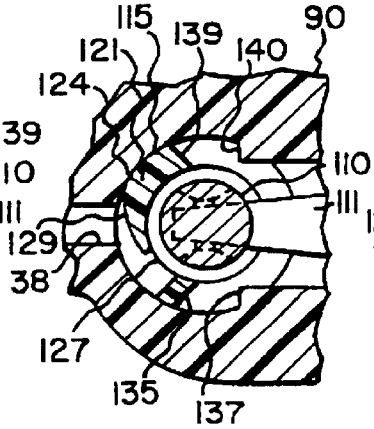
Fig. 13.
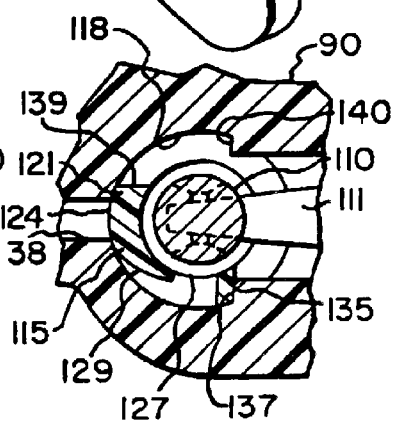
Fig. 14.

FIG. 27
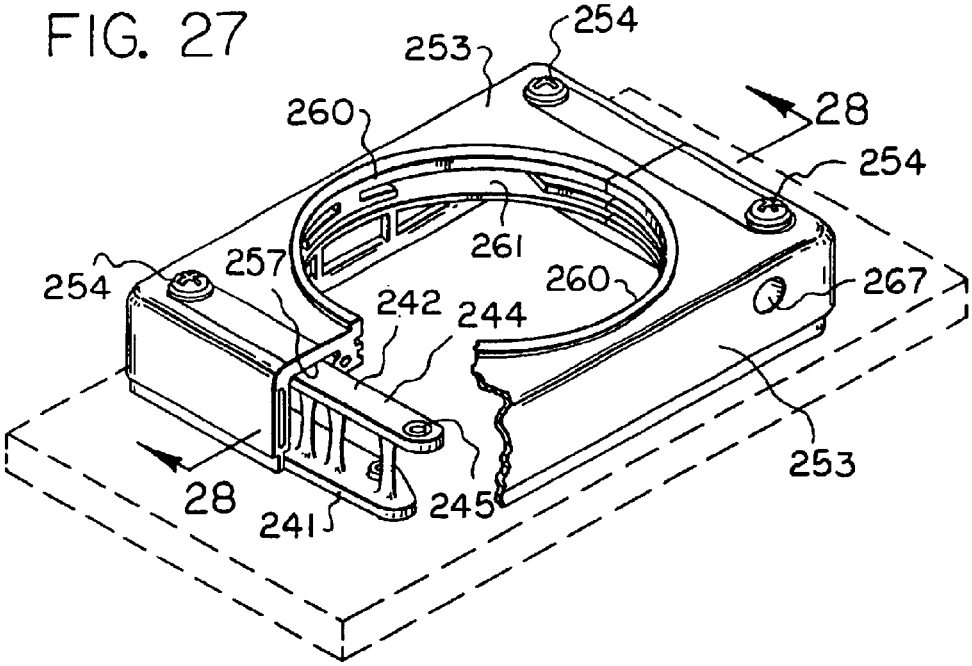
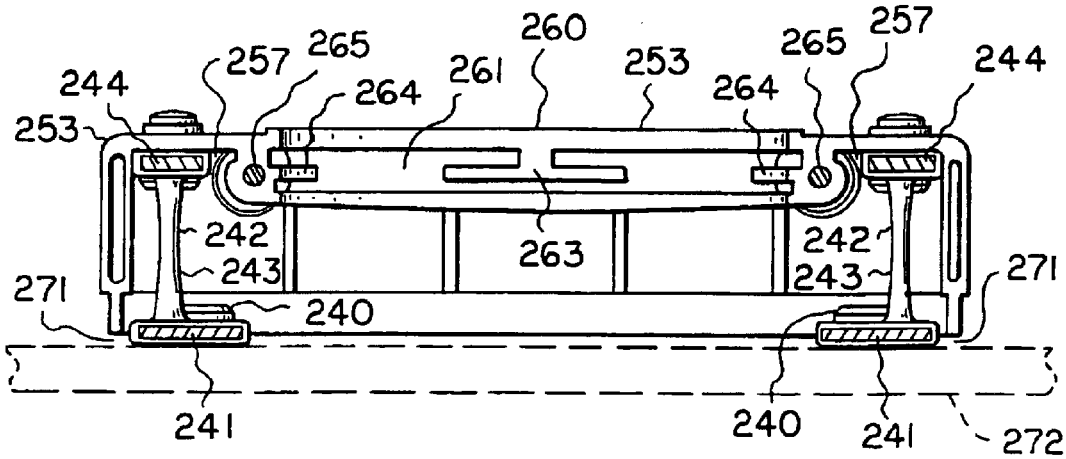
FIG. 28

FIG. 29
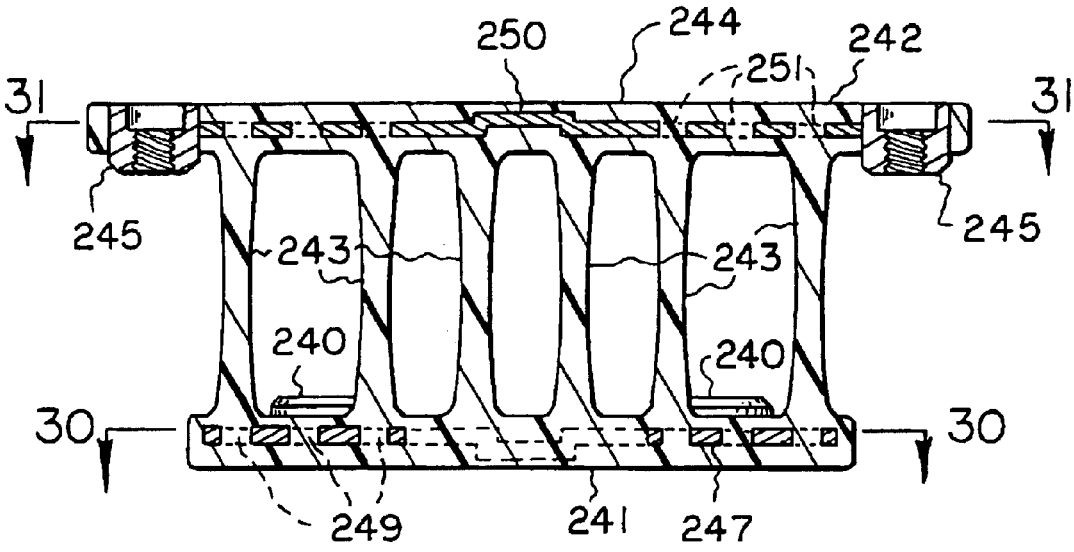
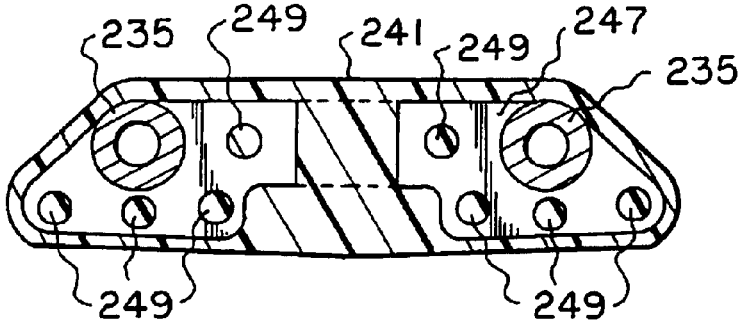
FIG. 30
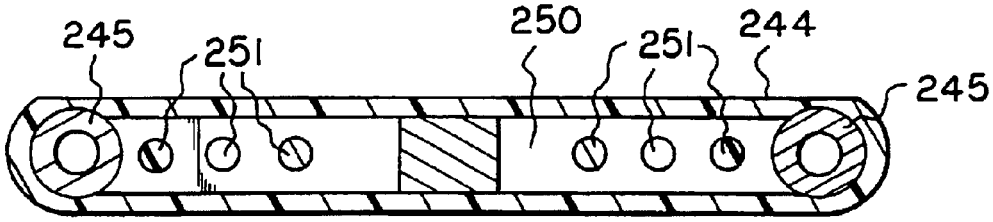
FIG. 31

ERGONOMICALLY FRIENDLY ORBITAL SANDER CONSTRUCTION

CROSS-REFERENCE TO RELATED APPLICATIONS

This application is a divisional of U.S. application Ser. No. 09/587,711 filed on Jun. 5, 2000, now abandoned which is a continuation-in-part of application Ser. No. 09/408,192, filed Sep. 29, 1999 now U.S. Pat. No. 6,257,970, which is a continuation-in-part of application Ser. No. 08/787,873, filed Jan. 23, 1997, now U.S. Pat. No. 6,004,197.

STATEMENT REGARDING FEDERALLY SPONSORED RESEARCH OR DEVELOPMENT

Not Applicable

BACKGROUND OF THE INVENTION

The present invention relates to an improved ergonomically friendly surface-treating tool in which a flat surface of a pad engages the surface of a workpiece for the purpose of abrading or polishing it and more particularly to an improved orbital sander.

By way of background, in operation, orbital sanders create forces at the sanding surface which are transmitted back to the operator's hand and arm through a lever which is the height of the orbital sander between the face of the sanding disc and the top of the casing at the vertical centerline of the sander. Therefore, if this height is as short as possible, the operator's effort in overcoming the forces produced at the face of the sanding disc are less than if the height was greater.

In orbital sanders it is desirable that, in addition for the height of the tool being as small as possible, the connection between the housing and the pad should be sufficiently flexible to permit good orbital action but it should also provide good columnar strength so that the pad will oscillate in a very close plane, that is, movement in a vertical direction should be limited as much as possible.

In prior orbital sanders there were various types of connections between the housing and pad. In one type, a central relatively soft rubber post connected the pad to the housing. While this provided sufficient orbital flexibility, it permitted the pad to move out of a desired plane. In another type, thin rigid plastic multi-columnar post units were located at the corners of the pad between the pad and the housing. These thin rigid post units provided good columnar stability so as to confine the pad to a desired plane, but they had to be relatively long so as to be sufficiently flexible laterally to provide good orbital action, thereby increasing the height of the sander.

In addition, in all prior orbital sanders, the abrasive dust enters the housing containing bearings which support the spindle which carries the pad, thereby shortening the bearing life and also causing the pad to operate out of its desired plane. This is especially pronounced in the type of orbital sanders using central vacuum systems wherein a high volume of air is drawn through the sander housing to carry away the abrasives and foreign particles. This causes eddy currents at the various sharp edges including the edges of the eccentric housing which contains the bearings which mount the spindle to which the pad is attached. Abrasives and foreign particles may thus enter the bearing area because they are sucked in to this area because of changes in positive and negative pressures due to the operation of the tool. One attempt to reduce the amount of foreign matter entering the bearing area is shown in U.S. Pat. No. 4,854,085 which utilized a triple seal. This approach did increase the bearing life to a certain degree. It is with overcoming the foregoing deficiencies of the prior art that the present invention is concerned.

BRIEF SUMMARY OF THE INVENTION

It is one object of the present invention to provide an improved orbital sander which has a relatively low height which contributes toward making the sander ergonomically friendly and which has good columnar strength between the housing and the pad so as to tend to confine the pad to an orbital plane while providing sufficient lateral flexibility for good orbital action.

Another object of the present invention is to provide an unique mounting between the housing and pad of an orbital sander which provides good lateral flexibility of the pad while tending to confine it to an orbital plane of operation.

A further object of the present invention is to provide an improved structural arrangement for essentially preventing foreign matter from entering the eccentric housing containing the spindle bearings of an orbital sander, thus prolonging the life of the bearings to a much greater extent than was heretofore possible by the use of prior types of seals. Other objects and attendant advantages of the present invention will readily be perceived hereafter.

The present invention relates to an orbital sander comprising a housing, a compressed air motor in said housing, a pad support secured to said motor, and first and second elongated rows of spaced plastic columns located on opposite sides of said motor and located between said housing and said pad support.

The present invention also relates to an orbital sander as set forth in the preceding paragraph including a shaft in said motor, a rotor mounted on said shaft, a compressed air duct in said motor for conducting compressed air to said rotor, an eccentric housing mounted on said shaft, a chamber in said eccentric housing, at least one bearing in said eccentric housing, said pad support being secured to said eccentric housing, and means in said motor for conducting compressed air to said chamber.

The present invention also relates to a plastic columnar unit for an orbital sander comprising an upper bar member, a lower bar member, and a row of a plurality of spaced columns between said upper and lower bar members.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 6 is an enlarged fragmentary cross sectional view taken substantially along line 6—6 of FIG. 5 and showing the structure of the motor exhaust tube, the dust discharge tube containing an aspirator, the connection therebetween and the connection between the dust discharge tube and the flexible hose;

FIG. 6A is a cross sectional view taken substantially along line 6A—6A of FIG. 6;

FIG. 7 is a fragmentary enlarged cross sectional view taken substantially along line 7—7 of FIG. 4 and showing the compressed air valve inlet structure;

FIG. 8 is a fragmentary cross sectional view taken substantially along line 8—8 of FIG. 7 and showing the compressed air flow adjusting valve in a full open position;

FIG. 9 is a view similar to FIG. 8 but showing the valve in a partially open position;

FIG. 10 is a view similar to FIG. 8 and showing the valve in a fully closed position;

FIG. 11 is an enlarged fragmentary enlarged cross sectional view similar to FIG. 7 but showing the compressed air inlet valve in an open position;

FIG. 11A is an enlarged perspective view of the compressed air flow control valve;

FIG. 11B is a side elevational view of the compressed air flow control valve;

FIG. 12 is a fragmentary cross sectional view taken substantially along line 12—12 of FIG. 11 and showing the relationship between the position between the compressed air inlet valve and the air flow adjusting valve when the latter is in a fully open position;

FIG. 13 is a view similar to FIG. 12 but showing the relationship when the air flow adjusting valve is in a partially open position;

FIG. 14 is a view similar to FIG. 12 but showing the relationship when the air flow adjusting valve is in a closed position;

FIG. 27 is a fragmentary perspective view showing the lower housing sections assembled with the columnar units;

FIG. 28 is a cross sectional view taken substantially along line 28—28 of FIG. 27;

FIG. 29 is a cross sectional view of the columnar unit taken substantially along line 29—29 of FIG. 26;

FIG. 30 is a cross sectional view taken substantially along line 30—30 of FIG. 29; and FIG. 31 is a cross sectional view taken substantially along line 31—31 of FIG. 29.

DETAILED DESCRIPTION OF THE INVENTION

The present invention relates to an orbital sander which has a relatively low height and thus is ergonomically friendly, while also providing good columnar strength to maintain the pad in a close orbital plane and also permitting good orbital flexibility. Its low height is due in part to the compressed air motor which drives it, and this motor is the same that is used in the three previous types of random orbital sanders which are described hereafter. Its low height is also due to the use of a columnar connection between the housing in the pad which provides good columnar strength while providing good orbital flexibility.

The compressed air motor which is used in the orbital sander of the present invention is also used in the three basic types of random orbital sanders which are described hereafter. The first and most rudimentary type is the non-vacuum type which does not have any vacuum associated with it for the purpose of conveying away the dust which is generated during a sanding operation. The second type is the central vacuum type which has a vacuum hose attached at one end to a central vacuum source and at its other end to a fitting which is in communication with the shroud of the sander so as to create a suction which carries away the dust which is generated during a sanding operation. The third type is a self-generated vacuum type wherein the exhaust air from the air motor is associated with an aspirator in communication with the shroud for carrying away the dust which is generated during a sanding operation. While not specifically shown in the orbital sander of the present invention of FIGS. 22-31, it will be appreciated that the above features of the central vacuum type and self-generated vacuum type may be incorporated therein.

Summarizing in advance, the orbital sander of the present invention shown in FIGS. 22-31 includes the compressed air motor of the foregoing type of sanders which, in part, permits the sander of the present invention to have a relatively low height, which thus reduces stresses experienced by the operator. However, it will be appreciated that the elongated rows of spaced plastic columns which secure the pad plate to the housing in FIGS. 22-31 may be used with other motors which do not have the low height of the motor described hereafter.

Figure 1:
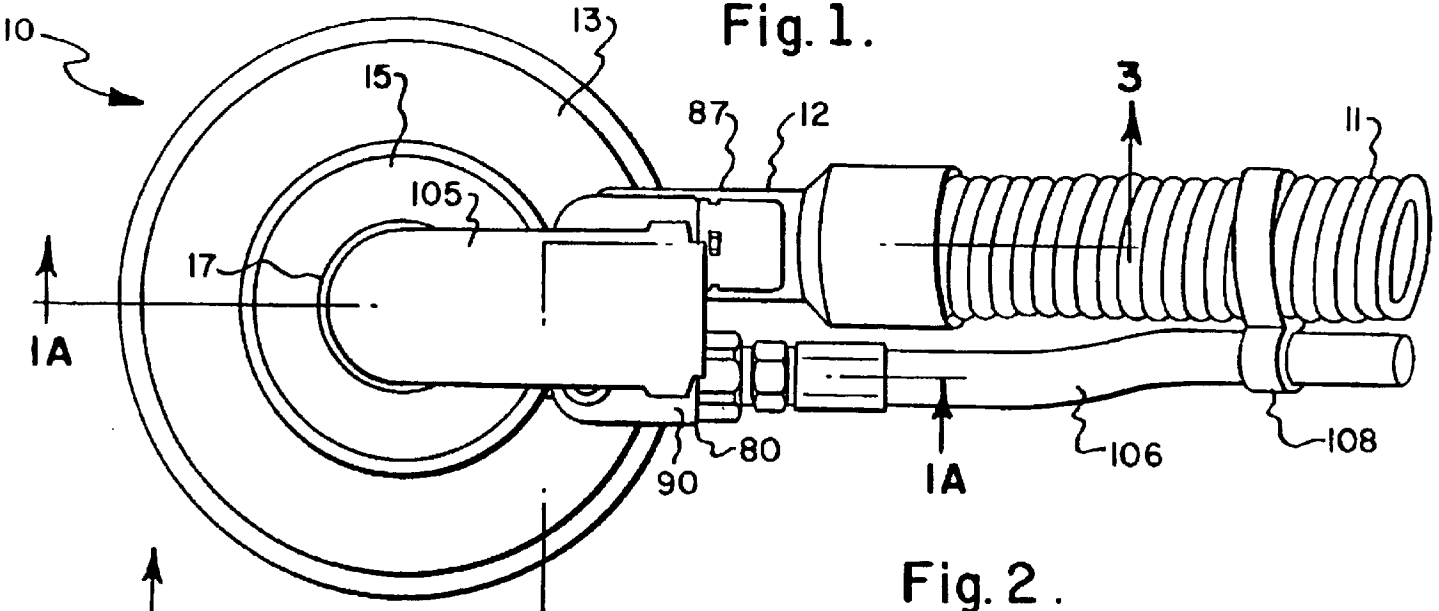
FIG. 1 is a fragmentary plan view of a central vacuum orbital sander with the vacuum hose and the compressed air hose connected to the orbital sander.
Figure 1A:
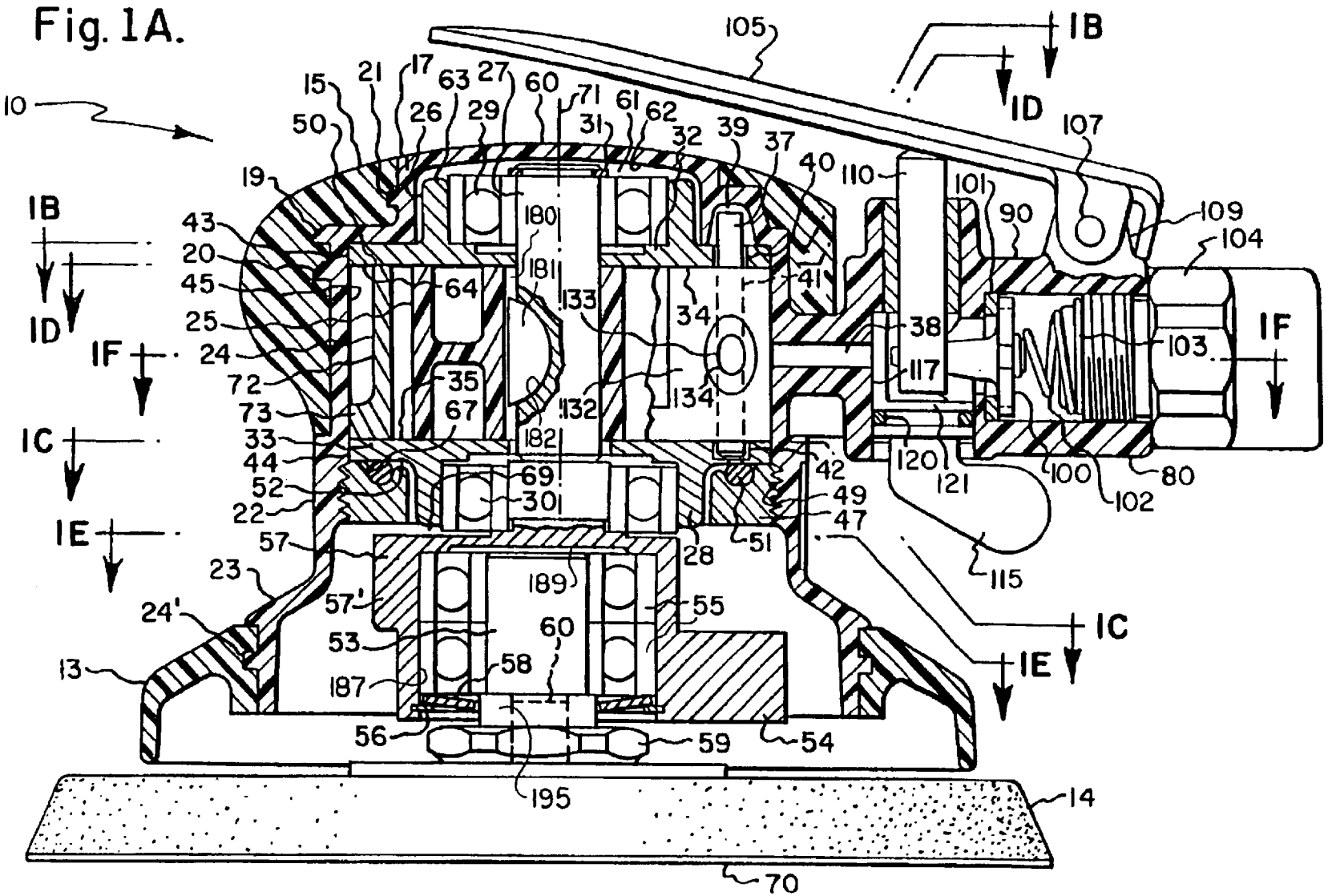
FIG. 1A is an enlarged fragmentary cross sectional view taken substantially along line 1A—1A of FIG. 1.

In FIGS. 1, 1A, 2, 2A, 2B and 3 a central vacuum type of random orbital sander 10 is disclosed wherein a flexible vacuum hose 11 is connected between the dust discharge tube 12 and the shroud 13 which surrounds the sanding disc 14. However, the only difference between the central vacuum type orbital sander 10 and a non-vacuum type is that the latter does not have the dust discharge tube 12 or the flexible hose 11. The basic structure which is common to all three types of orbital sanders is shown in FIG. 1A which is taken along line 1A—1A of FIG. 1. The sander of the foregoing figures is being described hereafter for the purpose of setting forth the structure of the compressed air motor used in the orbital sander of the present invention shown in FIGS. 22 et seq. which contributes in part to the low height of the sander of the present invention.

Figure 2:
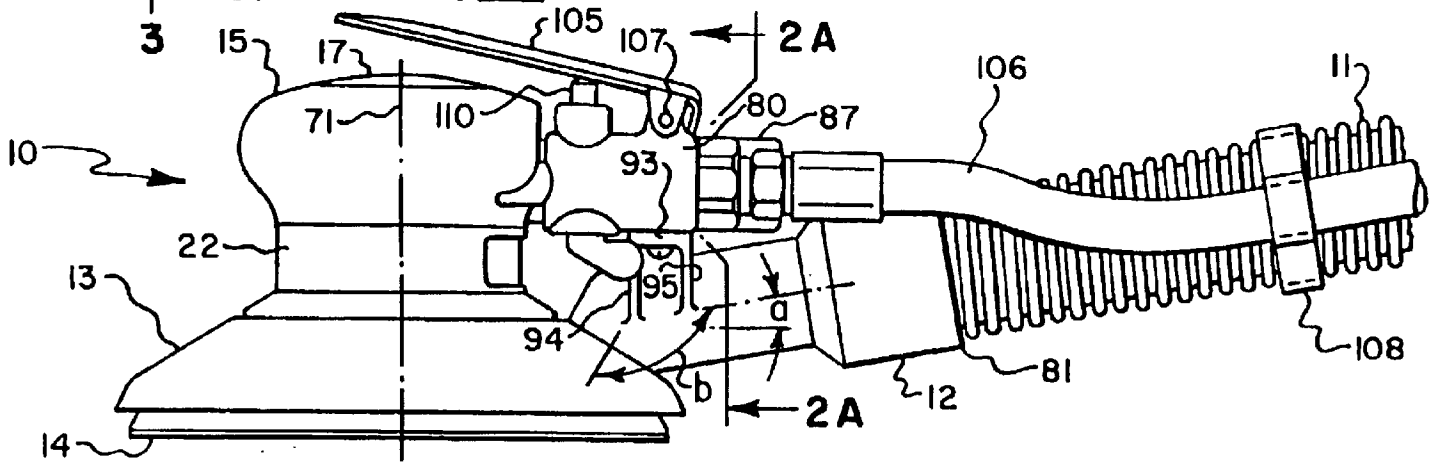
FIG. 2 is a fragmentary side elevational view of the orbital sander of FIG. 1.
Figure 3:
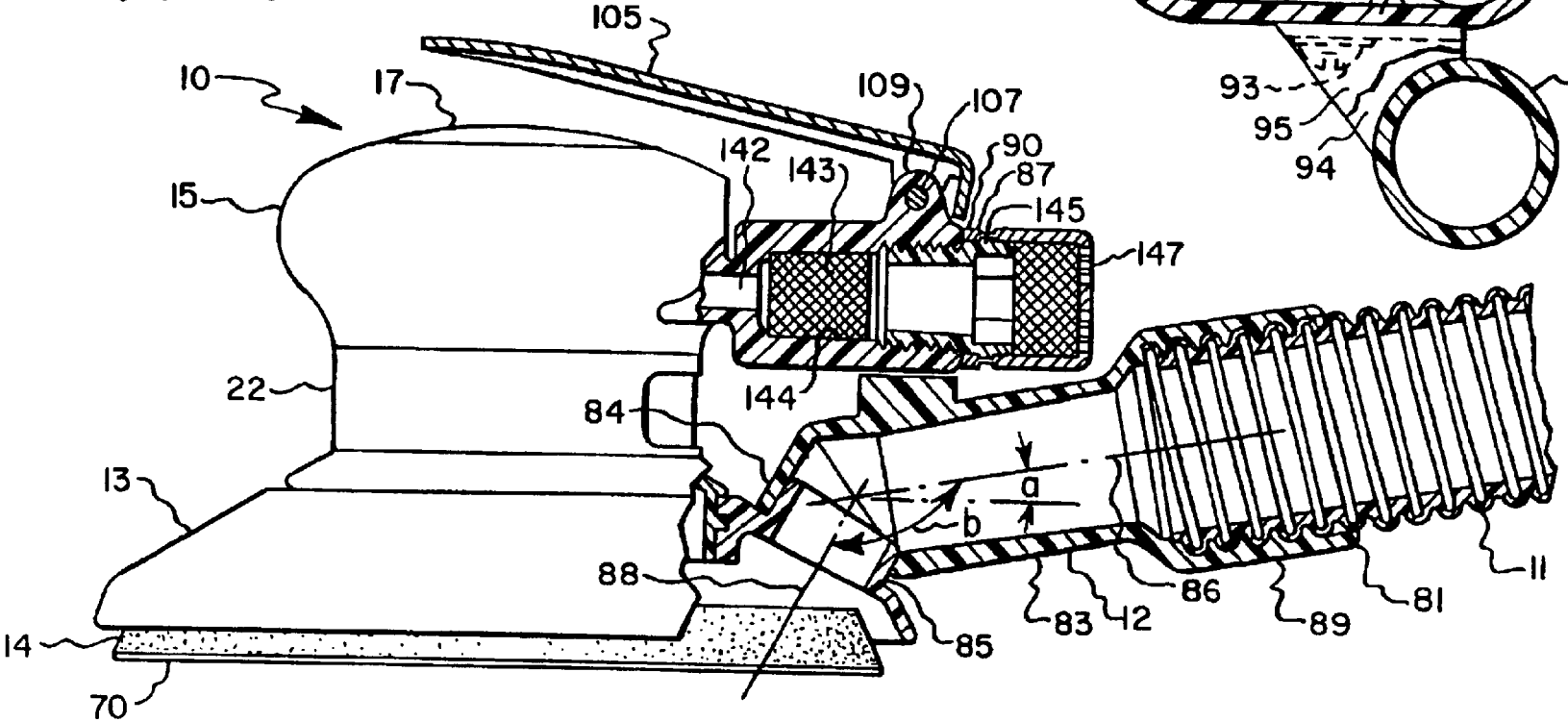
FIG. 3 is a fragmentary view, partially in cross section, taken substantially along line 3—3 of FIG. 1, and showing the relationship between the shroud and the dust discharge tube and the discharge hose; and also showing the relationship between the motor exhaust tube and the dust discharge tube.
Figure 4:
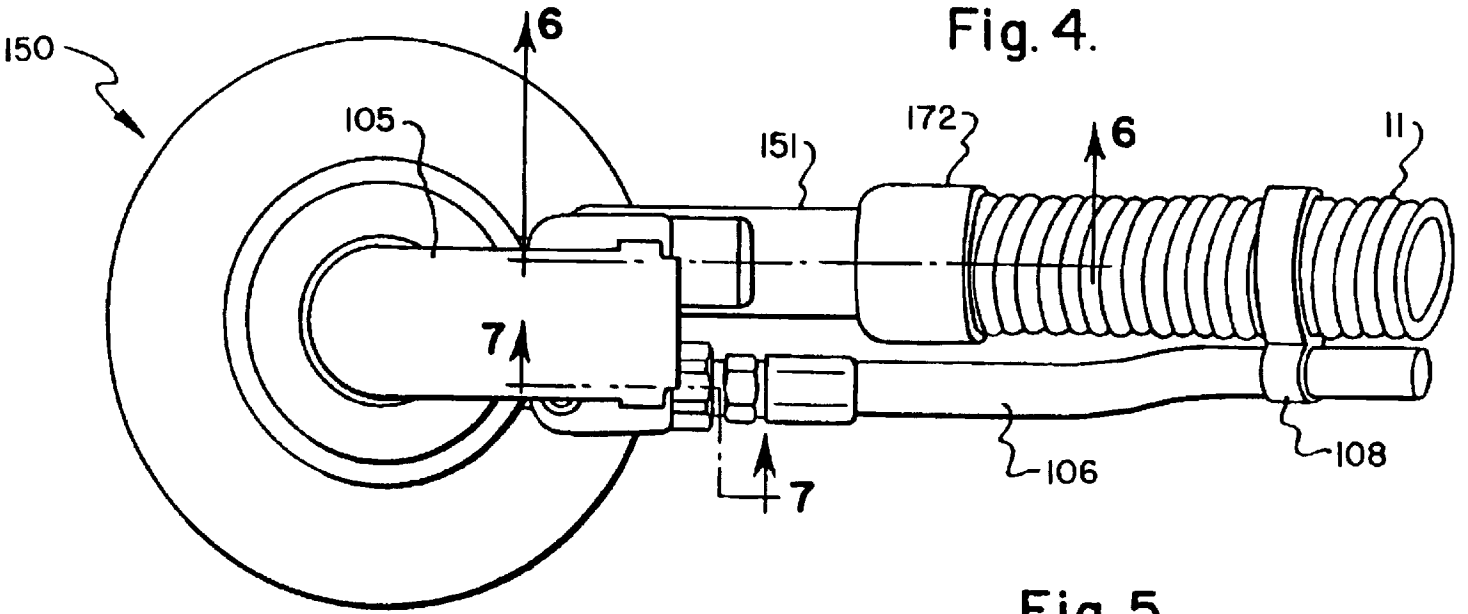
FIG. 4 is a fragmentary plan view of a self-generated vacuum orbital sander with the vacuum hose and the compressed air hose connected to the orbital sander and to each other.

The basic construction of the random orbital sander of FIGS. 1-3 includes a housing grip 15 of a rubber type material which is mounted on plastic housing 17 and secured thereon by coacting with ribs 19, 20 and 21 which extend partially around housing 17. Housing 17 also includes a lower portion 22 which terminates at a skirt 23 having an annular rib 24' thereon onto which flexible plastic shroud 13 is mounted with a snap fit.

An air motor is located within housing 17, and it includes a cylinder 24 in which a rotor 25 keyed to shaft 27 by key 28 is mounted. The ends of shaft 27 are mounted in bearings 29 and 30 (FIG. 1A), and a snap ring 31 retains shaft 27 in position. The cylinder 24 is part of a cylinder assembly which includes an upper plate 32 and a lower plate 33. The bearing 29 is mounted into annular portion 63 of upper plate 32, and the bearing 30 is mounted into annular portion 28 of lower plate 33. The end plates 32 and 33 include planar surfaces 34 and 35, respectively, which bear against the ends of cylinder 24 to thereby provide the required sealing with the adjacent portions of the cylinder 24. A pin 37 has an upper end which is received in a bore 39 in housing 17. Pin 37 passes through a circular bore 40 in end plate 32 and through a bore 41 in cylinder 24 and into a bore 42 in end plate 33, thereby aligning the end plates 32 an 33 with the cylinder 24. The outer circular ends 43 and 44 of end plates 32 and 33, respectively, have a tight fit with the internal surface 45 of housing 17. A threaded lock ring 47 is threaded into tapped portion 49 of housing 17 to thus cause the upper surface 50 of end plate 32 to bear against the adjacent surface of housing 17. An O-ring 51 in a groove in lock ring 47 bears against the undersurface 52 of lower end plate 33. Rotor shaft 27 has an eccentric housing 57 formed integrally therewith into which bearings 55 are mounted and retained therein by snap ring 56 which bears on Belleville washer 58. Housing 57 is an eccentric having two counter-weights 54 and 57'. A stub shaft 53 is press-fitted into bearings 55 and it is formed into a nut 59 at its outer end. Thus, rotor shaft 27 will rotate and eccentric housing 57 will simultaneously rotate with shaft 27. A threaded shaft 60 extends upwardly from sanding disc 14 and is received in stub shaft 53.

Figure 1B:
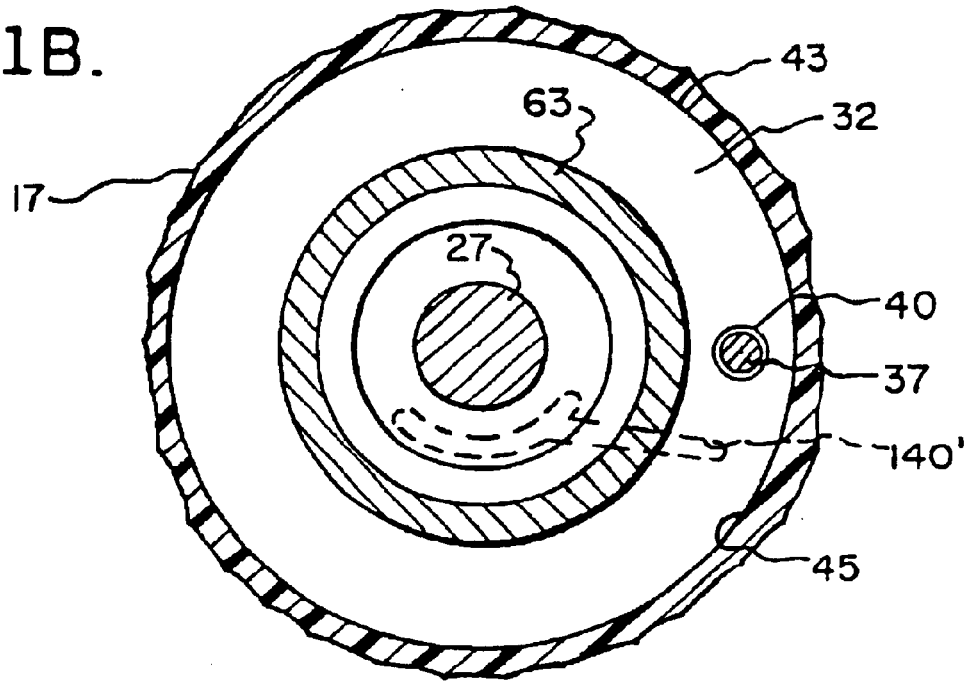
FIG. 1B is a cross sectional view taken substantially along line 1B—1B of FIG. 1A.
Figure 1D:
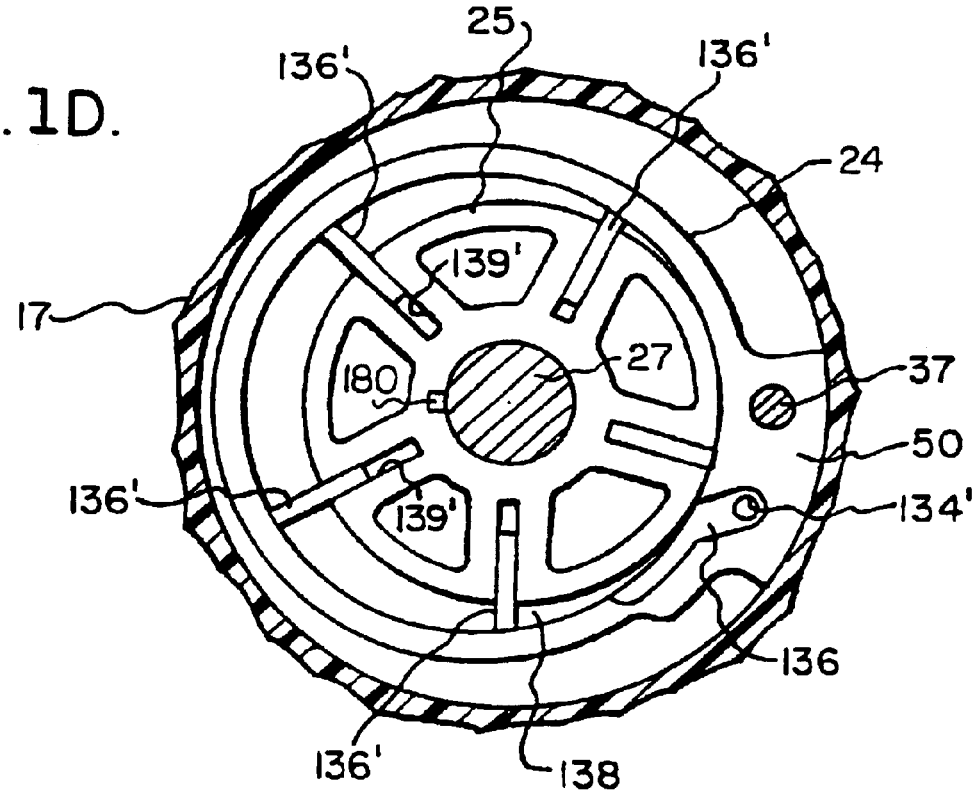
FIG. 1D is a cross sectional view taken substantially along line 1D—1D of FIG. 1A.
Figure 1C:
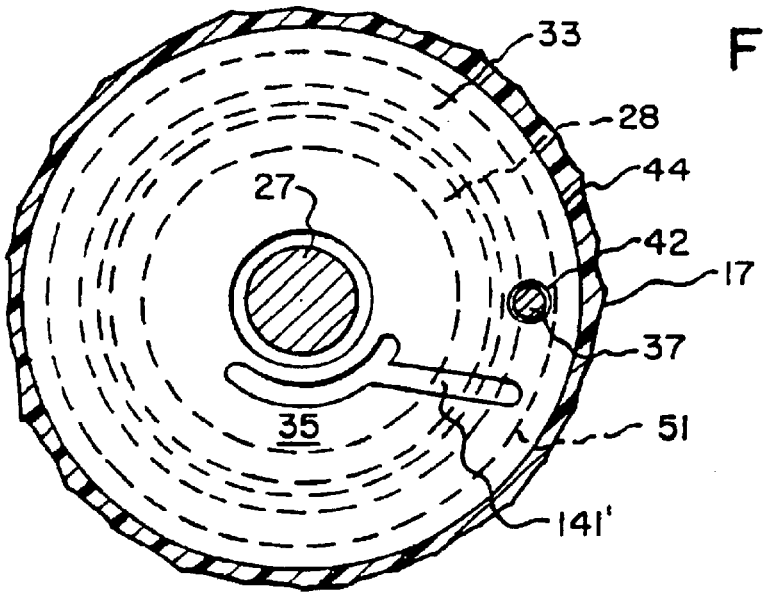
FIG. 1C is a cross sectional view taken substantially along line 1C—1C of FIG. 1A.
Figure 1E:
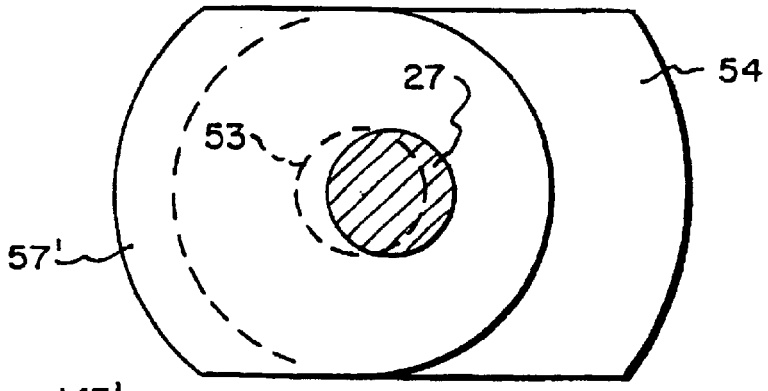
FIG. 1E is a cross sectional view taken substantially along line 1E—1E of FIG. 1A.
Figure 1F:
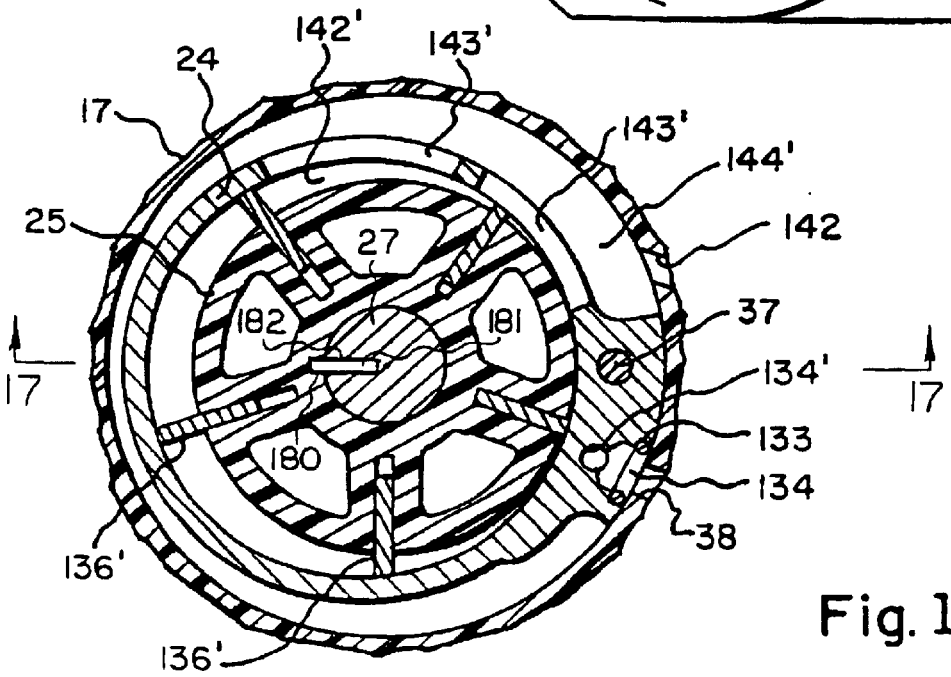
FIG. 1F is a cross sectional view taken substantially along line 1F—1F of FIG. 1A.

As can be seen from FIGS. 1A and 1F a compressed air inlet conduit 38 is in communication with bore 134 in cylinder 24, and bore 134 is in communication with bore 134' which extends axially between upper cylinder surface 50 (FIG. 1D) and lower cylinder surface 35 (FIG. 1A). Bore 134' is in communication with groove 136 (FIG. 1D) in upper cylinder surface 50 and a like groove (not shown) in lower cylinder surface 35. When upper plate 32 is in assembled position, it causes groove 136 to be a conduit leading to chamber 138 (FIG. 1D) within cylinder 24. Lower plate 33 forms a similar conduit with the groove which corresponds to groove 136 in lower cylinder surface 35. A plurality of vanes 136' (FIG. 1D) are slidably mounted in radial slots 139' in plastic rotor 25 and their outer ends contact the inner surface of cylinder 24 because they are forced outwardly by air pressure which is conducted to the inner ends of slots 139' by groove 140' (FIG. 1B) in the surface 64 of plate 32. Groove 140' is in communication with groove 136. Lower plate 33 (FIG. 1C) has a groove 141' which corresponds to groove 140' and is in communication with a groove which corresponds to groove 136. Air is exhausted from chamber 142' of cylinder through narrow slots 143' (FIG. 1F) a few millimeters wide in the central portion of cylinder 24, and this exhaust air passes into chamber 144' between cylinder 24 and housing 17, and it thereafter passes through bore 142 (FIGS. 1F and 3) into exhaust conduit 87.

Figure 5:
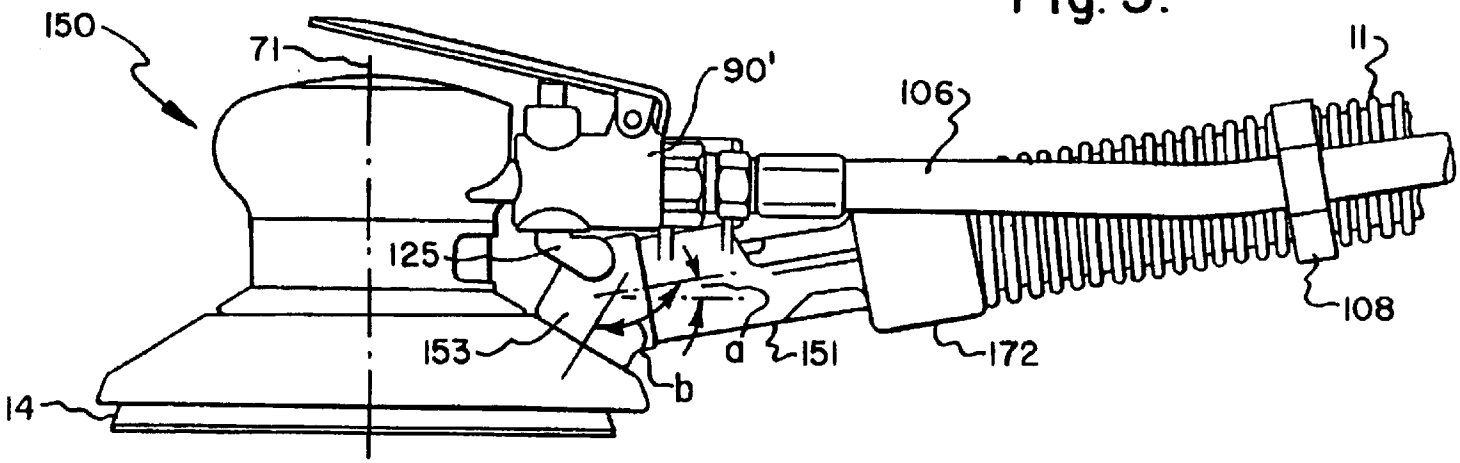
FIG. 5 is a fragmentary side elevational view of the sander of FIG. 4.

At this point it is to be noted that the air motor is of a conventional type which has been constructed for causing the overall height of the above-described unit in FIG. 5 to be lower than existing orbital sanders having a similar construction and for causing it to have a lower weight.

The modifications which have been made are as follows: The top 60 of housing 17 is 2.0 millimeters thick. Additionally, the clearance at 61 between the inner surface 62 of housing 17 and the edge 63 is 0.6 millimeters. In addition, the thickness of end plate 32 between surface 50 and surface 64 is 2.5 millimeters, and the thickness of end plate 33 between surface 35 and surface 67 is 2.5 millimeters. The cylinder 24' has an axial length of 20 millimeters. In addition, the clearance 69 is 0.5 millimeters. Also, nut 59 is 4.0 millimeters thick. The eccentric has a height of 21.4 millimeters. All of the foregoing dimensions have caused the air motor to have a height of 82.92 millimeters from the top of housing 17 to the face 70 of pad 14 at the vertical centerline 71. This compares to the lowest known existing prior art structure which has a height of approximately 89 millimeters to thereby reflect a difference of 6.08 millimeters or approximately 7%. In addition, the use of aluminum end plates 32 and 33, rather than steel, plus having the outer surface 72 of cylinder 24 to be 2 millimeters and the absence of an upper flange which corresponds to flange 73 and the thinning of aluminum end plate 33 and the thinning of nut 59 reduces the weight of the orbital sander of FIG. 5 to 0.68 kilograms as compared to a similar prior art sander which has a weight of 0.82 kilograms, thereby reflecting a difference of approximately 0.14 kilograms or about 17%. As noted above, the lesser weight makes it easier for a person to handle the orbital sander.

As noted above, the basic structure of the air motor is a well known conventional type having 150 watts minimum power at 0.61 bar air pressure minimum. The above features of the presently described air motor cause the orbital sander of FIGS. 1-21 to be of a relatively low height and a relatively low weight. Otherwise, the internals of the air motor are conventional.

Figure 15:
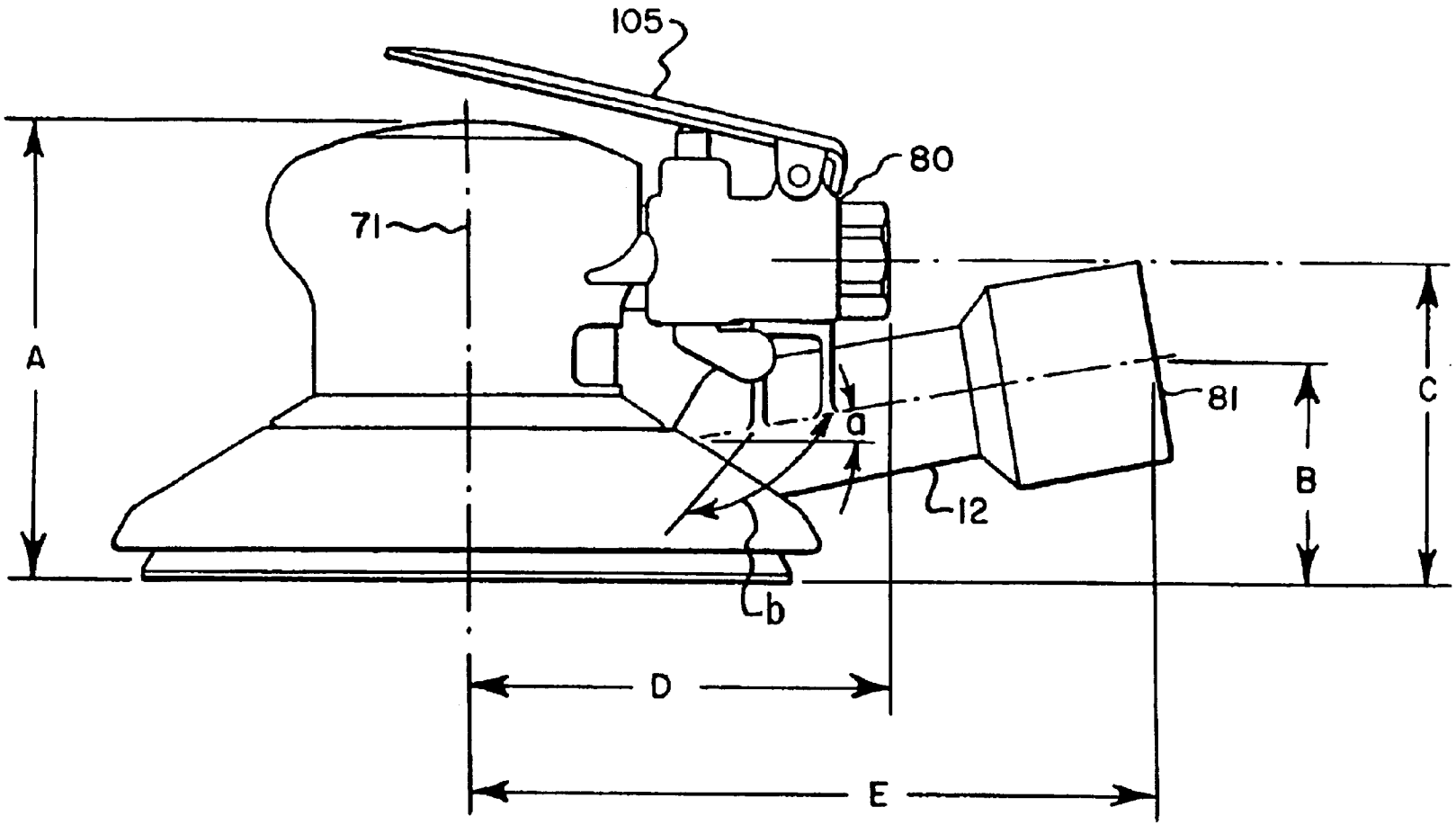
FIG. 15 is a side elevational view of a central vacuum type orbital sander showing the various dimensions which are considered in determining ergonomics.

The reduced height of sander 10 is depicted by letter A in FIG. 15. The fact that the entire height of sander 10 is lower, results in the lowering of the centerline of the outlet of the dust discharge tube to a dimension B and also results in the lowering of the centerline of the compressed air inlet 80 to a dimension C. As noted above, the lowering of dimensions B and C also results in enhancing the ease of handling of the orbital sander 10.

Figure 2A:
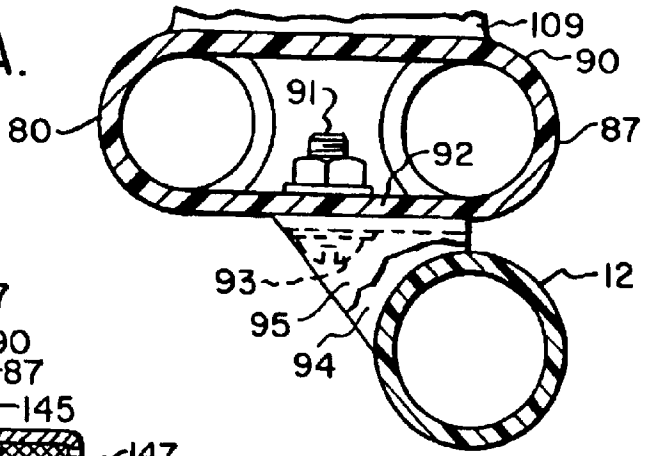
FIG. 2A is a fragmentary cross sectional view taken substantially along line 2A—2A of FIG. 2 and showing the support structure for the dust discharge tube.
Figure 2B:
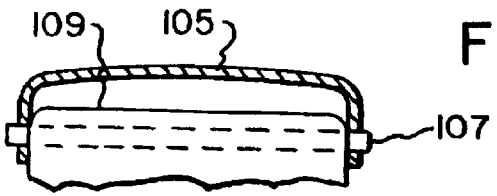
FIG. 2B is a fragmentary extension of the top of the structure shown in FIG. 2A.

The dust discharge tube 12 (FIG. 3) of sander 10 has a centerline 86 and is inclined to the horizontal at an angle a. The dust discharge tube 12 consist of a longer section 83 and a shorter section 84 which has a centerline 88 and which has a circular outlet which mounts on cylindrical stub pipe 85 formed integrally with shroud 13. The dust discharge tube portion 83 is located immediately below the motor exhaust inlet fitting 87. The air motor exhaust conduit 87 is within housing portion 90 which is molded integrally with housing 17. Housing portion 90 also contains compressed air inlet conduit 80 (FIGS. 1 and 2A). The dust discharge tube 12 is also attached to housing portion 90 by a bolt 91 which extend through horizontal portion 92 of unit 90 and also extends through web 93 which spans legs 94 and 95 molded integrally with dust discharge tube 12. Thus, dust discharge tube 12 is firmly supported on stub tube 85 and on housing portion 90 which contains the air motor exhaust conduit 87 and the compressed air inlet 80.

As noted briefly above, since the outer end portion 89 (FIG. 3) of dust discharge tube 12 is inclined upwardly, the adjacent portion of flexible vacuum hose 11 will also be inclined upwardly to thus cause it to droop further away from the outlet 89 then if the latter was horizontal. This tends to lessen the possibility that the flexible hose will contact the workpiece which could create a frictional drag. In addition, as can be seen from FIG. 2, since the flexible hose 11 is received directly in dust discharge tube 12, a fitting which is otherwise used at the outer end of a dust discharge tube in the prior art is eliminated which thus causes the extreme outer end 81 of discharge tube 12 to be at a distance E (FIG. 15) from the vertical centerline 71 of the sander. It will be appreciated that the shorter that the distance E is, the shorter is the lever arm tending to tilt the sander 10 and thus for any given weight at the outer end 81 of dust discharge tube 12, the shorter the lever arm E is, the lower will be the tilting force which is produced and the lower will be the force required by the operator to overcome this tilting force.

The compressed air inlet structure permits a very gradual varying of the pressure which is supplied to the air motor. In this respect, the compressed air inlet 80 includes a valve 100 (FIG. 1A) which is biased against seat 101 by spring 102 which has its outer end 103 bearing against the end of hollow compressed air fitting 104 which is threaded into housing portion 90. Fitting 104 (FIGS. 1, 2, 4 and 5) receives the end of compressed air hose 106 with a conventional connection. Hose 106 is attached to vacuum hose 11 by strap 108. In order to open valve 100 from the position shown in FIGS. 1A and 7 to the position shown in FIG. 11, lever 105 is pivotally mounted at 107 on boss 109 which is molded integrally with housing portion 90. When lever 105 is depressed, it will depress pin 110 from the position shown in FIG. 7 to the position shown in FIG. 9 against the bias of spring 102 in view of the fact that the extension 111 of valve 100 is received in a bore 112 at the lower end of pin 110. When lever 105 is released, the spring 102 will return valve 100 to the position of FIG. 7 and pin 110 will be raised to the position of FIG. 7 by virtue of its connection with valve extension 111. The foregoing structure of valve 100 is conventional.

A flow adjusting valve 115 (FIGS. 1A, 7, 11A and 11B) is located in bore 117 of housing portion 90 and it is retained therein by snap ring 119 (FIG. 7). Bore 117 has a wall 118. An O-ring 120 is mounted in a groove 122 of base 126 of valve body 121 (FIG. 11A). O-ring 120 performs both a sealing function and a frictional holding function to retain valve 115 in any adjusted position in bore 117. The valve consists of a portion 123 of a cylinder extending upwardly from base 126 and having an outer cylindrical surface 124. A handle 125 is molded integrally with valve body 121. The upstanding wall 123 includes an aperture 127 and an inclined groove 129 in communication with bore 127. The outer surface 124 is in sliding contact with wall 130 of bore 117. When valve 121 is in a fully open position shown in FIG. 8, bore 127 is in communication with bore 38 (FIG. 1A) of housing 17. Bore 38 terminates at wall 132 of air motor cylinder 25. An O-ring 133 is inserted in wall 132 (FIG. 1F) around bore 134 which provides a seal with the outer end of conduit 38. The foregoing structure is well known in the art.

As noted above, valve 115 is fully open in the position shown in FIG. 8. In FIG. 9 it is partially open and it can thus be seen that the air flow must pass along inclined groove 129 which restricts the opening to conduit 38. It will be appreciated that the more that wall 121 is moved in a counterclockwise direction, the smaller will be the path of communication leading to duct 38. In FIG. 10 the valve is shown in a fully closed position wherein the wall 124 completely closes off duct 38. At this time the edge 135 engages shoulder 137 to define the limit of counterclockwise movement of valve 115, as shown in FIG. 10. The clockwise limit of movement of wall 124 is determined when edge 139 engages shoulder 140, as shown in FIG. 10. The range of movement of valve 125 is 90° from a full open position to a full closed position.

FIGS. 12, 13 and 14 correspond to FIGS. 8, 9 and 10, respectively, but are taken along cross section line 12—12 above valve extension 111 whereas FIGS. 8, 9 and 10 are taken through valve extension 111 in FIG. 7.

In FIG. 3 motor air exhaust housing 87 is shown which is in communication with the exhaust of air motor cylinder 24 (FIG. 1A) through conduit 142 (FIG. 3). Housing 90 includes a muffler 143 which is held in position in bore 144 by plug 145 and the exhaust air exits housing 90 through perforated cap 147.

In FIGS. 4, 5, 6 and 7 a self-generated vacuum random orbital sander 150 is shown. This sander has the same internal structure described above relative to the central vacuum type, as shown in FIG. 1A. In addition, it has the same type of sanding pad 14 and it has the same type of valve 115 described above which is located in housing unit 90. The inlet valve 115 is identical to valve 125 described above in FIGS. 1A, 8, 9 and 10.

The self-generated vacuum random orbital sander 150 includes a dust discharge tube 151 which is also inclined to the horizontal at an angle a (FIG. 5). Dust discharge tube 151 includes an elongated portion 152 which has a centerline 156 (FIG. 16) and is received in elbow 153 which has a center-line 158 and which in turn is mounted on stub pipe 154 of shroud 13. A tubular strap portion 155 is formed integrally with portion 156. Motor exhaust unit 159 contains a porous muffler 160. A fitting 161 extends through strap 155 and is threaded into motor exhaust housing 159 at 162 and it includes a bore 163 and a plurality of apertures leading from bore 163 to conduit 165 which is the entry portion of bore 167 which functions as an aspirator 176 in conjunction with the areas 169 and 170 of elongated dust discharge tube portion 150. It is to be especially noted that the dust discharge from shroud 13 enters the straight portion of dust discharge tube 152 and the fact that there is no sharp bend in the immediate vicinity of areas 171 and 169, there will be greater efficiency than if such a bend existed immediately adjacent to conduit 165.

In addition to the foregoing, the flexible dust discharge hose 11 is received in the enlarged portion 172 at the outer end of dust discharge tube 151 in the same manner as described above relative to the embodiment of FIGS. 1-3. The outer portion 170 of aspirator 176 is nested within the innermost portion of dust discharge hose 11 (FIG. 6), thereby contributing to the overall relative shortness of dust discharge tube 151.

It is to be noted that the dust discharge tube 151 is inclined at an angle a to the horizontal and that elbow 153 is inclined at an angle b to the horizontal.

Figure 16:
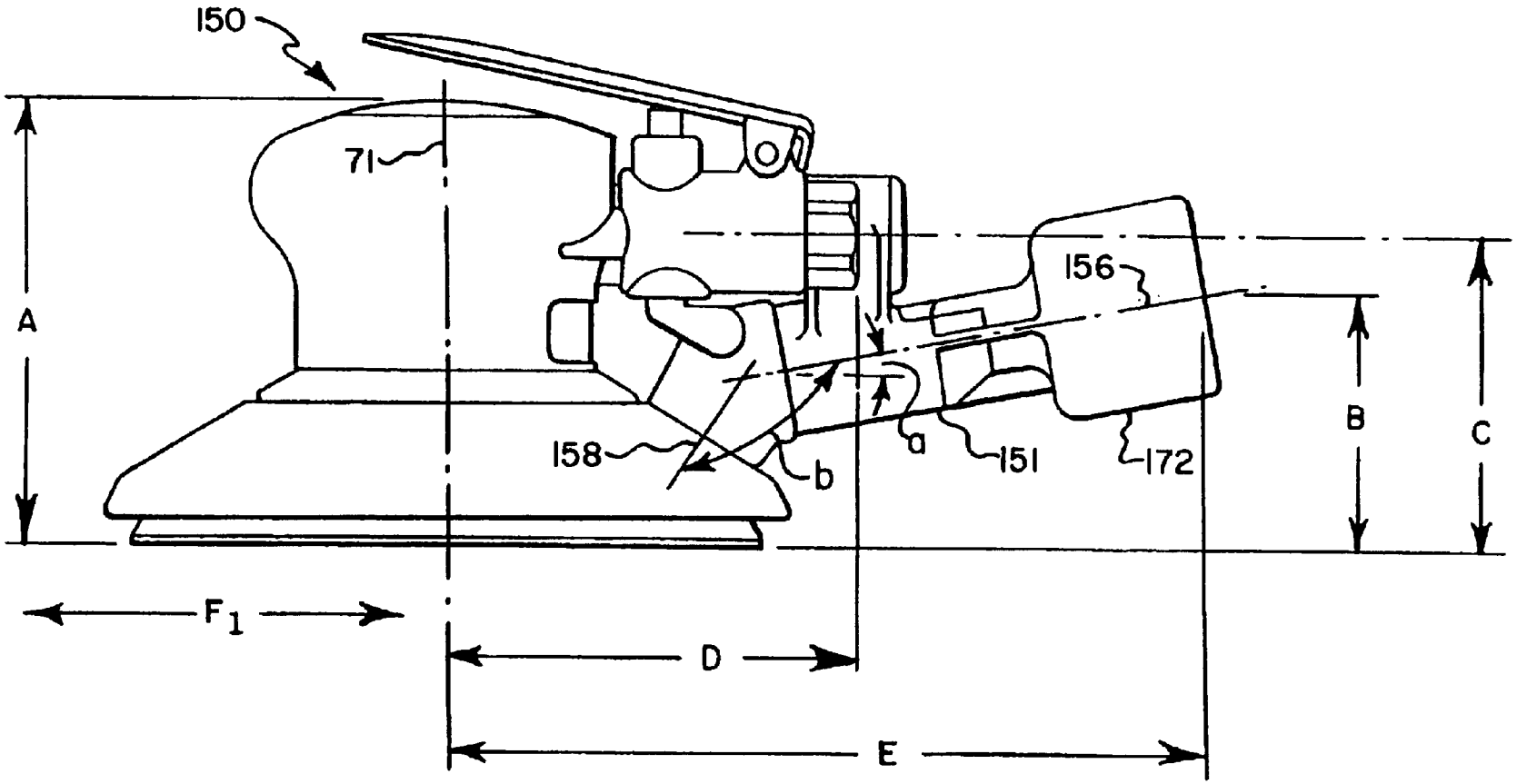
FIG. 16 is a side elevational view of a self-generated vacuum type of orbital sander showing the various dimensions which are considered in determining ergonomics.

It is to be further noted from FIG. 16 that the centerline of dust discharge tube 151 at the outer end of portion 172 is a distance E from the vertical centerline 71 of the random orbital sander 150. Dust discharge tube 151, in addition to being inclined, is relatively short so that any downward force at its outer end will be relatively close to the vertical centerline 71 and will therefore create less of a force which the operator must oppose than if it were longer.

The following table sets forth the dimensions A through E and angles a and b shown in FIGS. 15 and 16.

TABLE

DIMENSIONS IN MILLIMETERS OF VARIOUS PORTIONS OF DIFFERENT TYPES OF ORBITAL SANDERS

| | NON-VACUUM | SELF-GENERATED VACUUM | CENTRAL VACUUM |
|---|---|---|---|
| A | 82.92 | 82.92 | 82.92 |
| B | — | 47.45 | 40.42 |
| C | 58.42 | 58.42 | 58.42 |
| D | 80.00 | 80.00 | 80.00 |
| E | — | 147.28 | 130.05 |
| Angle a | — | 10° | 10° |
| Angle b | — | 130° | 130° |

A is the height between top of sander and sanding disc pad surface at vertical centerline of sander.
B is the height between centerline of discharge tube and sanding disc pad surface at outlet of discharge tube.
C is the height between centerline of compressed air inlet and sanding disc pad surface.
D is the horizontal distance between vertical centerline of sander and extreme outer portion of compressed air inlet.
E is the horizontal distance between vertical centerline of sander and extreme outer portion of the dust discharge tube.
Angle a is the angle between the horizontal, or the face of the pad, and the centerline of the dust discharge tube.
Angle b is the angle between the centerlines of the two portions of the dust discharge tube.

In the above table, the dimension E is 130.05 millimeters for the central vacuum sander and 147.28 millimeters for the self-generated vacuum sander. However, if the threaded connection at outer end portion 89 (FIG. 3) of dust discharge tube 12 of the central vacuum sander is decreased by two threads at 5 millimeters each, then the 130.05 dimension E would be decreased about 10 millimeters to about 120 millimeters. Also, if the threaded end portion 172 of the self-generated vacuum sander is decreased by two threads at 5 millimeters each, the 147.28 dimension E would be decreased 10 millimeters to about 137 millimeters. It is possible with a slight loss of ergonomics to lengthen the dimension E for the central vacuum and self generated vacuum sanders by about 10 millimeters to about 140 millimeters and about 157 millimeters, respectively. However, when the foregoing lengthened dimensions E are considered in combination with the lower height dimension A, each of the foregoing sanders will still be more ergonomically friendly than sanders not having this combination of dimensions.

As noted briefly above, the closest known prior art sander of the above-described type shown in FIGS. 1-21 has a height dimension of approximately 89 millimeters as compared to height dimension A of 82.92 millimeters of the above-described sander. As further noted above there is a difference of about 7% between the two dimensions. The 82.92 millimeter dimension is the ultimate low dimension which was able to be achieved while still retaining the various component parts of the sander in a commercially operable manner for providing the desired output parameters noted above and also recited hereafter. However, it will be appreciated that the height dimension A of the present sander can be increased a few millimeters by not reducing the thickness and height of the various components as much as was done. Accordingly, it is contemplated that the height dimension A can be increased to 86 millimeters which would still be a reduction in height from 89 millimeters or approximately 3.5%.

Additionally, as noted above the closest known prior art sander of the present type has a weight of 0.82 kilograms as compared to the weight of the present sander of 0.68 kilograms, or a difference of 0.14 kilograms or a weight reduction of approximately 17%. It will be appreciated that the weight of the sander of the present invention may be increased to 0.75 kilograms which would be a difference of approximately 0.07 kilograms, and this would be a weight reduction of approximately 8.3% which also could be significant.

The preferred angle a shown above in the table is an acute angle of 10°. However, this angle may be as small as about 5° and as high as about 30°. The exact acute angle for any specific device will depend on various factors such as the length of the motor exhaust body which is located directly above it and the vertical spacing between the shroud outlet and the motor exhaust body.

As noted above, the angle b is 130°, but it can be any obtuse angle consistent with the acute angle a of the dust discharge tube.

The non-vacuum sander, the central vacuum sander 10 and the self-generated vacuum sander 150 utilize a 150 watt power air motor which operates from a source providing 6.1 bar air pressure and the air motor is capable of providing up to 10,000 revolutions per minute.

Figure 21:
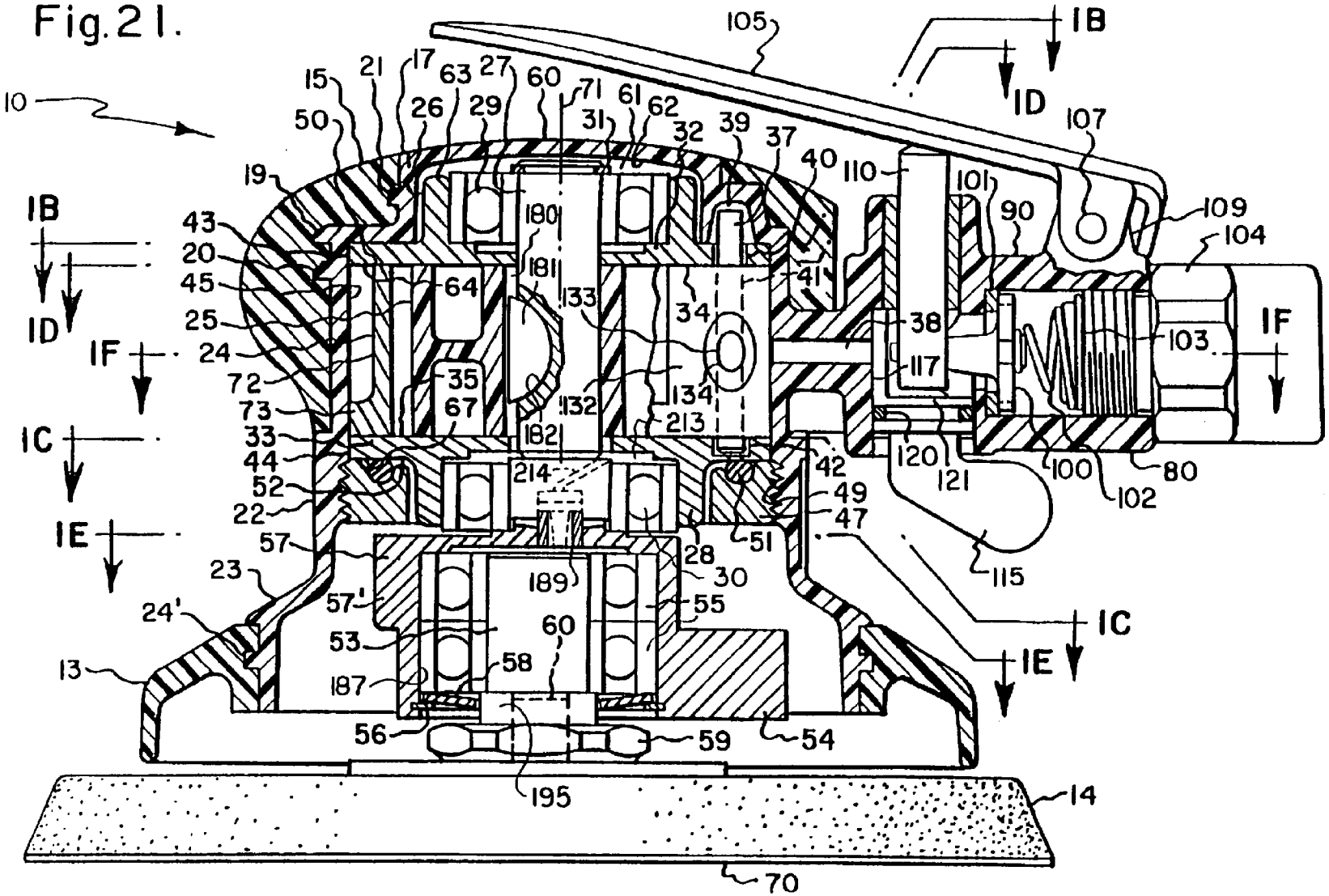
FIG. 21 is a view similar to FIG. 19 and showing another embodiment of a duct which includes an inclined duct or bore in the rotor shaft for conducting compressed air to the bearings in the eccentric housing.
Figure 22:
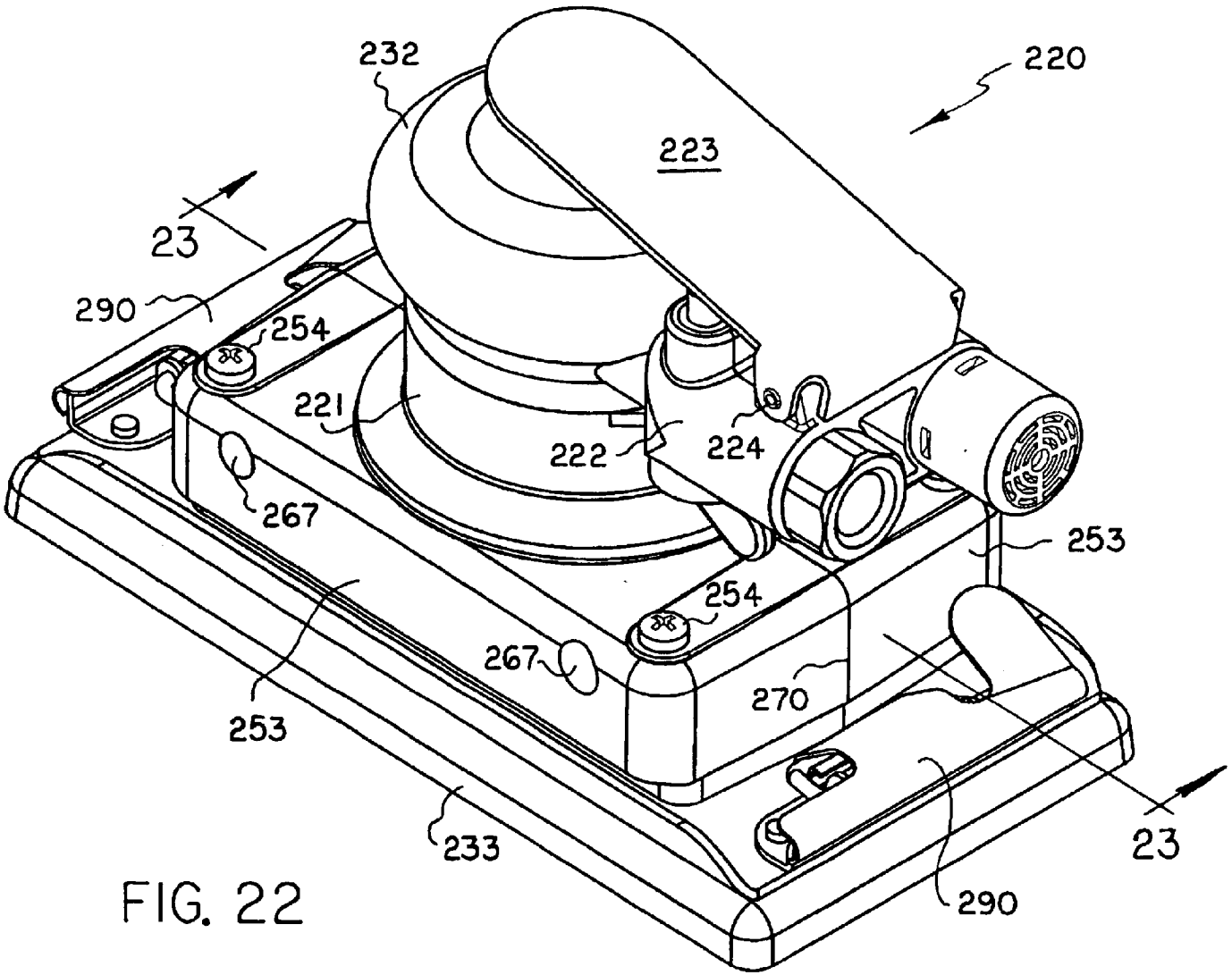
FIG. 22 is a perspective view of the improved orbital sander of the present invention having the unique columnar mounting units between the housing and the pad.

It is to be especially noted that the foregoing discussed dimensions are intended to preferably apply to the three types of random orbital sanders discussed above relative to FIGS. 1-21, and while the dimensions of the air motor are preferably incorporated in the orbital sander of FIG. 22 et seq., the other dimensions listed in the above table relating to the angles and dimensions of the hose connections are optional. It will also be appreciated that the connections between the housing and the pad of the orbital sander shown in FIG. 22 et seq. may be used independently with other types of motors, and that such connections are not restricted to the use with an air motor having the dimensions discussed above.

In accordance with another aspect of the present invention, the bearings 276 (FIG. 23), which are analogous to the bearings 55 (FIGS. 1A and 17), are supplied with compressed air and a one-way valve which prevents foreign matter from effectively entering the eccentric housing 57 in which they are located. In this respect, it is to be noted from FIGS. 1A, 1B, 1C, 1D and 1F that compressed air is conducted from bore 38 (FIGS. 1A and 1F) through bore 134 and into bore 134'. The compressed air then passes into groove 136 (FIG. 1D) in cylinder surface 50 and a counterpart groove (not shown) in cylinder surface 35. The compressed air then passes through groove 140' (FIG. 1B) in surface 64 of plate 32 from groove 136, and it also passes through groove 141' (FIG. 1C) from the counterpart (not shown) of groove 136. As expressed above, the compressed air emanating from grooves 140' and 141' enter the radial slots 139' (FIG. 1D) of the rotor 25 to force vanes 136' outwardly.

There is a working clearance between the parts of air motor consisting of cylinder 24 and rotor 25 and plates 32 and 33. Thus the compressed air from grooves 140' and 141' will pass between plate 32 and rotor 25 and will also pass between plate 33 and rotor 25. This compressed air will then enter rotor keyway slot 180 (FIGS. 1A, 1D and 1F), and then pass around key 181 which is located in key slot 182 in shaft 27.

Figure 17:
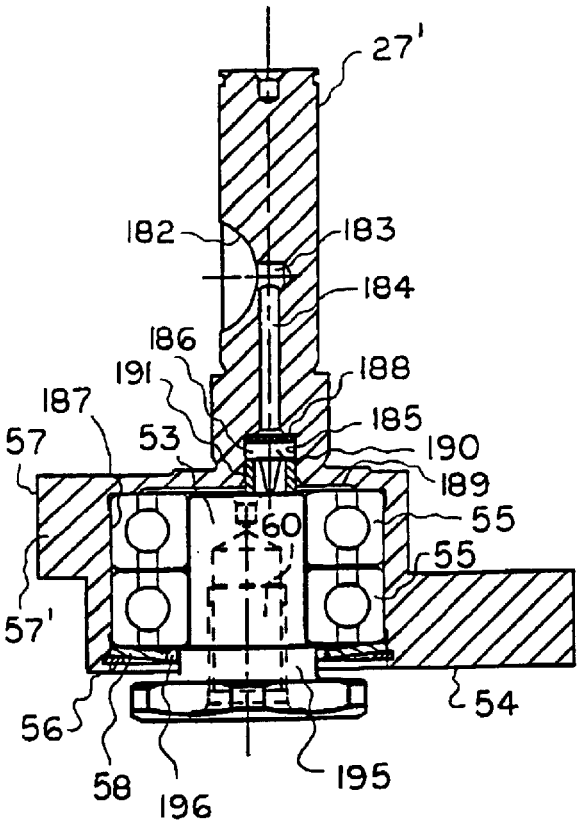
FIG. 17 is a cross sectional view taken substantially along line 17—17 of FIG. 1F and showing a modification of the rotor shaft for positively pressurizing the bearings in the eccentric housing.
Figure 18:
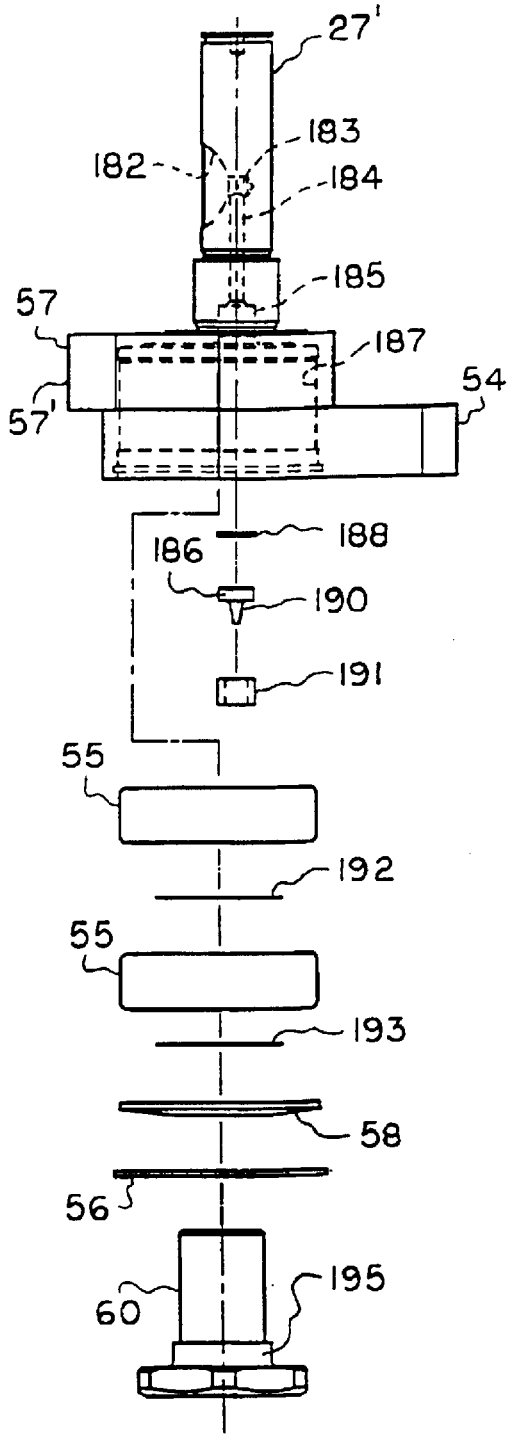
FIG. 18 is an exploded view of the rotor shaft and related structure of FIG. 17.

In accordance with one embodiment of the present invention, the shaft 27 of the air motor has been modified to be shaft 27' shown in FIGS. 17 and 18. In this respect, a cross bore 183 has been drilled in shaft 27', and a coaxial duct in the form of a bore 184 has been drilled in the lower part of shaft 27' in communication with bore 183, and a counterbore 185 has been drilled in the lower end of bore 184. Counterbore 185 is in communication with the chamber 187 of eccentric housing 57 in which bearings 55 are located. As can be seen from FIGS. 1A and 17, there is a small space 189 in chamber 187 above the uppermost bearing 55. A filter disc 188, which is fabricated of spunbonded polyester, and a duckbill one-way valve 190 are located in counterbore 185 and retained therein by retaining sleeve 191 which is press-fitted into counterbore 185 and bears against the enlarged annular portion 186 of valve 190. The filter 188 filters the compressed air passing through the duckbill valve. As shown in FIG. 18, there is a spacer 192 between bearings 55, and there is a spacer 193 between lower bearing 55 and Belleville washer 58. Spacers 192 and 193 are thin annular metal discs which fit on stub shaft 53, and their outer diameters bear on the inner races of bearing 55 without obstructing the spaces between the inner and outer races. The upper spacer 192 spaces the two bearings 55 so that their outer races do not contact each other. The lower spacer 193 also functions somewhat as a labyrinth seal to create a tortuous path back to the lower bearing 55 when air tends to suck upwardly into the lower bearing 55 when the motor stops. The foregoing structure thus causes air flow into chamber 187 and through bearings 55 and through the annular space 196 between Belleville washer 58 and portion 195 of stub shaft or spindle 53 into the space above sanding disc 14. This pressure is more positive than the pressure outside of eccentric housing 57, thereby preventing sanding dust and other foreign materials from entering bearings 55 in chamber 187 from the area above pad 14. It is to be noted that since duckbill valve 190 is a one-way valve, the air in chamber 187 cannot be drawn back into bore 184 when the air motor inherently functions as a pump when the compressed air flow thereto is terminated, thereby obviating the induction of foreign material laden air into chamber 187.

Figure 19:
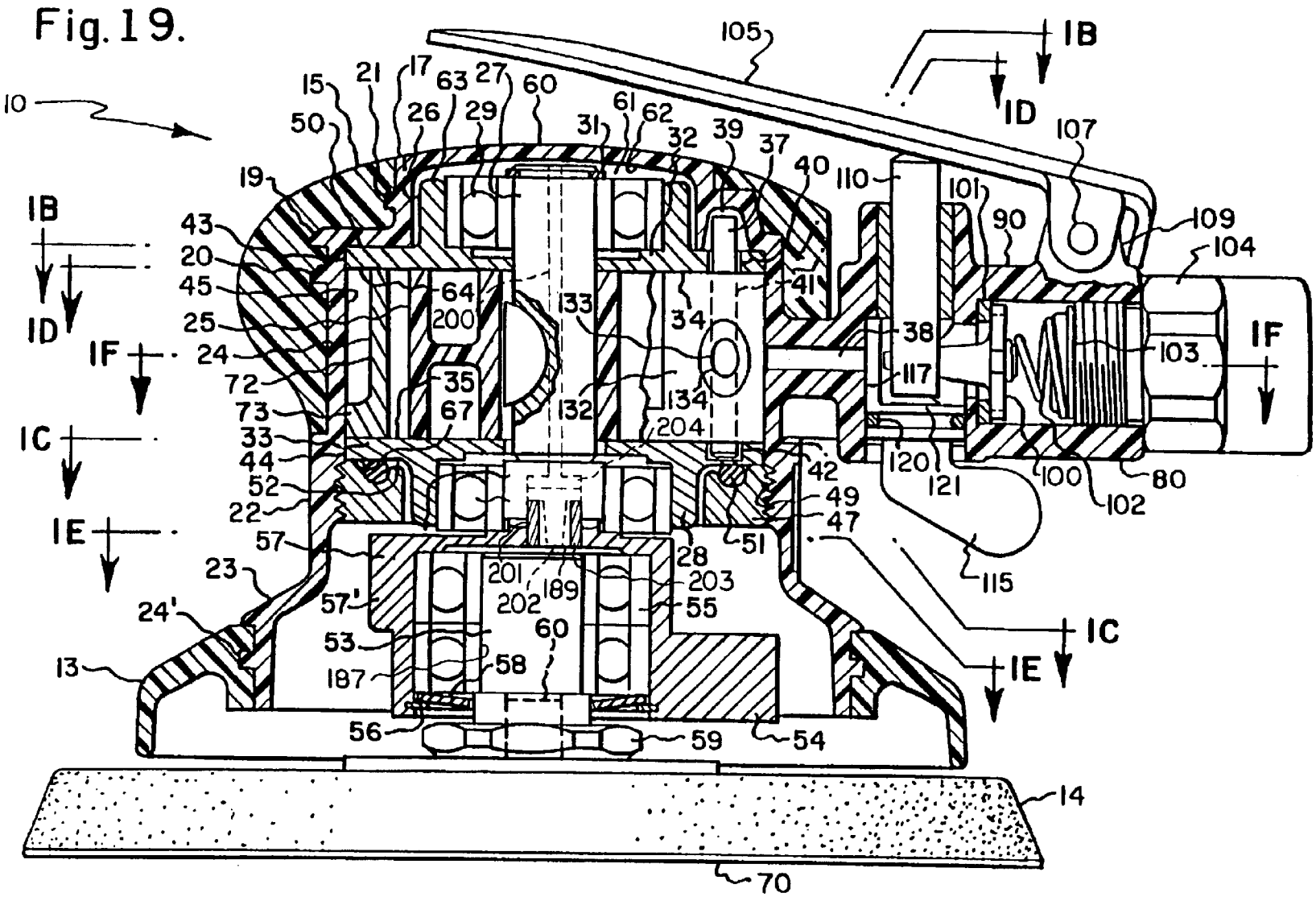
FIG. 19 is a modified form of FIG. 1A showing another embodiment for conducting compressed air to the bearings in the eccentric housing.

In FIG. 19 another embodiment of the present invention is disclosed. All parts which are identical to the numerals in FIG. 1A represent identical elements of structure. In FIG. 19 motor shaft 27 has been modified by creating a duct in the form of a bore 200 therein which extends from the top of shaft 27 to counterbore 201 which is in communication with space 189 within eccentric housing chamber 187. A duckbill valve 202 is located in counterbore 201 and is retained therein by press-fitted sleeve 203, as in the embodiment of FIGS. 17 and 18. A filter 204 which is of the same type described above and designated 188 is located above valve 202 within counterbore 201.

Bore 200 receives its air from clearance space 61. In this respect, there is leakage between shaft 27 and plate 32, and this air also passes through upper bearing 29 to effect cooling thereof and thereafter it passes into clearance space 61 from which it passes into the top of bore 200 which leads to filter 204 and duckbill valve 202. The air emanating from duckbill valve 202 functions in the same manner as described above relative to duckbill valve 190 of FIGS. 17 and 18.

It is to be especially noted that in the embodiments of FIGS. 17, 18 and 19, the only modification has been to the existing shaft of the random orbital tool, and that there has been no requirement for any ducts in the cylinder 24 in which rotor 25 rotates.

Another way of conducting compressed air to bore 200 in FIG. 19 is to drill a small hole (not shown) in upper plate 32 so that compressed air will pass through this hole, through bearing 29 (FIG. 1A) and through space 61 into duct or bore 200. This hole may receive its air from duct 140' (FIG. 1B) or from the clearance between planar surface 34 of plate 32 and cylinder 24. Also, the hole in plate 32 need not be directed to bearing 29, but may be positioned to communicate with clearance space 61 through the clearance between the planar surface 34 of plate 32 and cylinder 24 and through annular portion 63 (FIG. 1B) of plate 32. Also bore 200 may obtain compressed air because of leakage around the outer circumferential edge 43 of plate 32 into clearance space 61.

Figure 20:
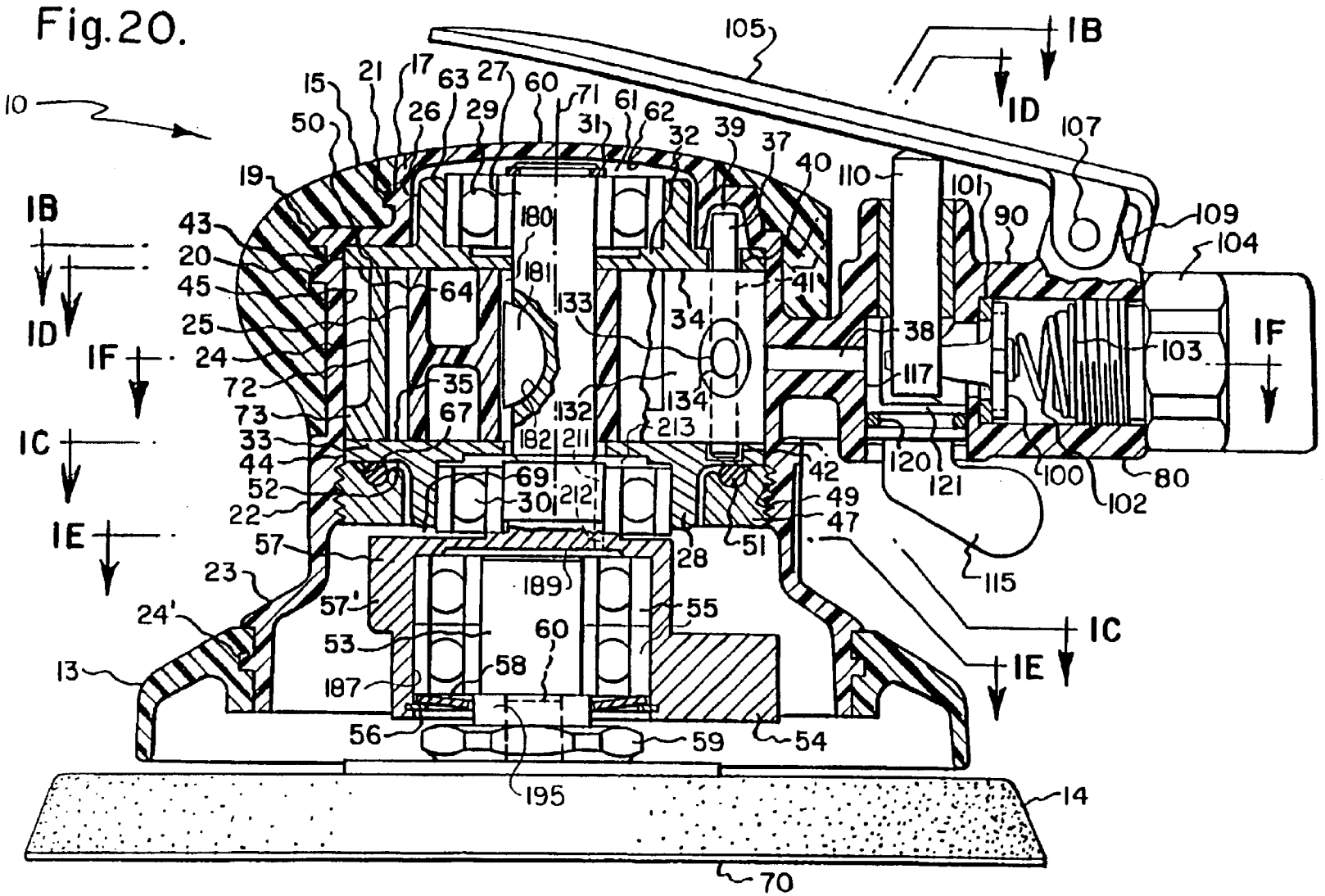
FIG. 20 is a view similar to FIG. 19 and showing a duct in the form of a slot in the rotor shaft for conducting compressed air to the bearings in the eccentric housing.

Still another way of providing compressed air to bearing chamber 187 is shown in FIG. 20, and it would be to form a duct in the form of a slot 211 on the outside of the portion of shaft 27 which is abreast of bearing 30 and drill a hole 212 in line with slot 211 through the top of housing 57 into chamber 187. Slot 211 would have its open side covered by the contiguous inner race of bearing 30. Compressed air could thus pass from clearance space 213 into bearing chamber 187, the clearance space 213 receiving its compressed air through the clearance between the undersurface of rotor 25 and the planar upper surface of plate 33 and through keyway 180. In this embodiment the compressed air does not pass through a duckbill valve and filter.

Another way of conducting compressed air to chamber 187 is shown in FIG. 21 wherein an inclined duct or bore 214 is drilled through the portion of shaft 27 abreast of bearing 30 and duct 214 is in communication with a counterbore (not numbered) housing a filter and duckbill valve, such as shown and described in FIGS. 17-19 so that there is communication between clearance space 213 and small space 189 in chamber 187 through the filter and duckbill valve.

It will be appreciated that the various clearances referred to above through which compressed air passes are considered to be ducts within the housing through which compressed air is conducted to bearing chamber 187.

In FIGS. 22-31 the improved orbital sander 220 of the present invention is shown. Orbital sander 220 is of the same general type shown in FIG. 4, namely, a non-vacuum type of sander which does not have any vacuum associated with it for the purpose of conveying an abrasive dust which is generated during a sanding operation. However, it will be appreciated that it may be of the other types noted above, namely, the central vacuum type which has a vacuum hose attached at one end to a central vacuum source or the type which is a self-generated vacuum type wherein the exhaust air from the air motor is associated with an aspirator in communication with the shroud for carrying the weighted dust which is generated during a sanding operation.

The orbital sander 220 includes an upper housing section 221 having an integral air inlet duct 222. Lever 223 is pivotally mounted on pin 224 and it functions in the same manner described above relative to FIG. 11, or it can function in any other suitable way known in the art to control the flow of air to compressed air motor 225 which may be identical in all respects to that shown above in FIGS. 1A through 1F except that the shaft 227 is of a different configuration as are the eccentric housing 229 and the counterweights 230 and 231. The housing grip 232 of rubber-type material is mounted on housing section 221.

A pad 233 is secured to pad backing plate 234 by a plurality of screws 235 (FIG. 25) which extend through openings, such as 237 in pad 233, and through openings 239 in pad backing plate 234 and are received in nuts 240 which are molded integrally into the bases or lower bar members 241 of columnar units 242 each having a row of a plurality of spaced plastic columns 243 molded integrally therewith, with said columns 243 being molded integrally with upper bar member 244. Each bar 244 includes nuts 245 molded therein. While the columns 243 of each row are shown in alignment, it will be appreciated that they may be staggered or offset. The columns are of tapered circular cross section throughout and have the dimensions shown in FIG. 29A with their smallest dimension at each midpoint, which is the most flexible part of each column. In other words, the columns flare outwardly from positions substantially at their midpoints. I will be appreciated that the columns may be of other cross sectional shapes, such as cylindrical, and that such shapes could function, but they would not function in the same manner as the specific shape show. It will also be appreciated that the smallest cross sectional dimension of each column need not be located substantially at its midpoint, but can be placed anywhere between its ends. Also, it will be appreciated that there can be more than one reduced cross sectional area in each column. The preferred shape and dimensions of the columns 243 are shown in millimeters in FIG. 29A, along with the height dimension of the columnar unit 241.

In its more specific aspects, the base 241 of each columnar unit 242 includes an embedded metal plate 247 (FIGS. 29 and 30). The configuration of metal plate 247 is such that it has apertures 249 therein through which the molded plastic of base 241 extends. Thus, plates 249 rigidize bases 241. Also, the nuts 235, in addition to being molded into bases 241, are also set into plates 247. Thus, each base 241 is essentially reinforced plastic which provides great rigidity.

Each upper bar member 244 also includes a metal plate 250 confined fully within upper bar member 244. Metal plate 250 includes a plurality of apertures 251 similar to apertures 249 of lower bar member 241 through which the molded plastic of header 242 extends. Nuts 245, as noted above, are molded into each upper bar member 244, and these nuts also are in abutting relationship to each apertured plate 250.

Figure 29A:
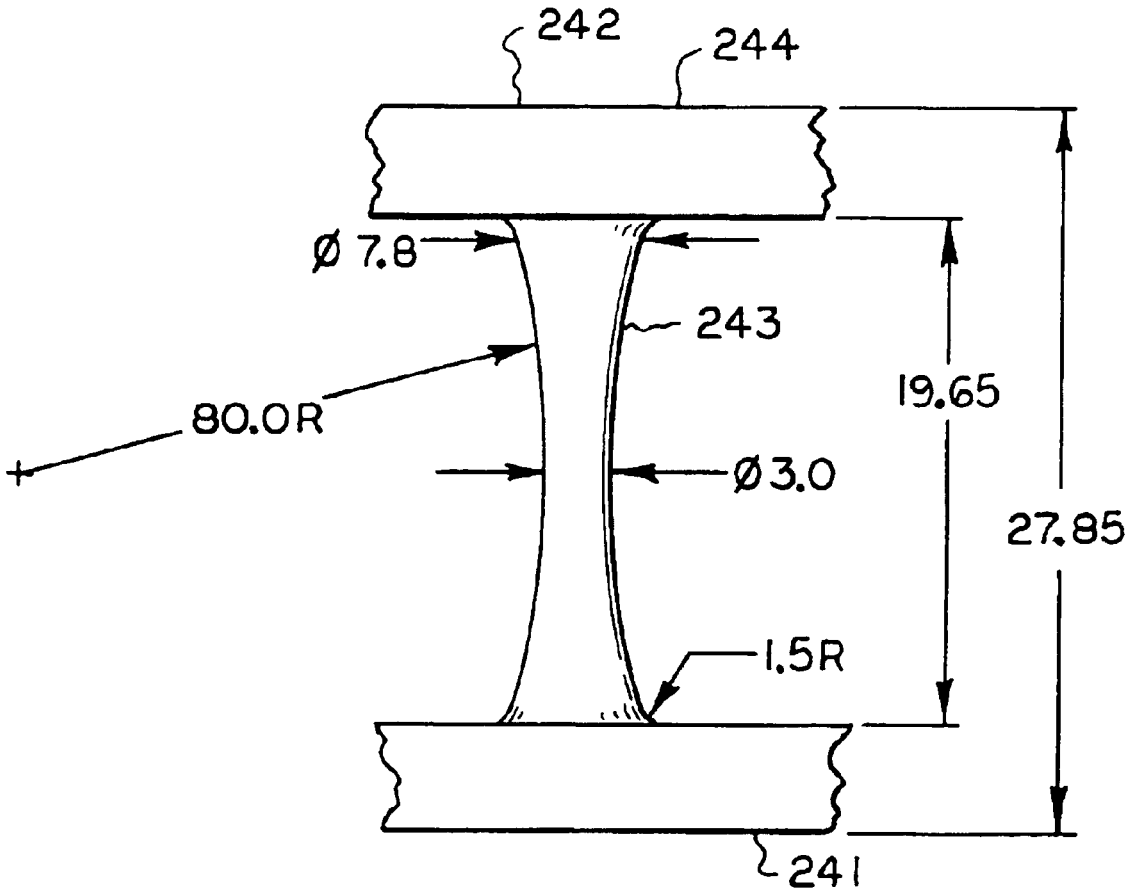
FIG. 29A is a view showing the preferred structure of a column of the columnar unit.

The plastic of column assemblies 241 is molded polyester and is grade "High Performance" and can be commercially obtained from DuPont Engineering Polymers Company under the trademark HYTREL and is further identified by number 5546. This plastic provides good columnar strength while permitting good lateral flexibility so that the pad 233 secured to lower bar members 241 of columnar units 242 will have a good orbital motion while the plastic columns 243 provide good columnar strength. The outside height dimension across bar members 241 and 244 is 27.85 millimeters before it is mounted (FIG. 29A). It will be appreciated that other suitable plastics may be used.

The columnar units 242 are secured to housing sections 253 by screws 254 which extend through suitable apertures 255 in housing sections 253 and are received in nuts 245. The upper bar members 244 of columnar units 242 fit into recesses 257 of identical housing sections 253.

Identical housing sections 253 are secured to upper housing section 221 in the following manner. Housing section 221 is identical to housing section 22 of FIGS. 2 and 1A. In this respect, housing section 221 includes an annular groove 259 (FIG. 23) which receives ridge 260 of each identical lower housing section 253. A ridge 261 (FIG. 23) is received in groove 262 of lower housing sections 253. Ridge 261 of upper housing section 221 is of complementary mating relationship to groove 262 in that it is interrupted to receive the ridge configurations 263 and 264 of upper housing sections 253 which act as keys to prevent relative rotation between upper housing section 221 and lower housing section 253. Any other suitable connection between the upper housing section 221 and lower housing sections 253 can be used.

The lower housing sections 253 are secured to each other and to upper housing section 221 by nut and bolt assemblies. In this respect, bolts 265 extend through bores 267 in lower housing sections 253 and are retained therein by nuts 269 such that lower housing sections 253 assume an end-to-end abutting relationship such as shown in FIGS. 22 and 27 along seam 270.

By virtue of the above-discussed construction, upper housing section 221 is firmly attached to lower housing section 253. The upper bar members 244 of columnar units 242 are firmly secured to lower housing sections 253, and the pad plate 234 is firmly secured to lower bar members 241 of columnar units 242. There is a space 271 (FIG. 28) between the lower edges of lower housing sections 253 and the upper surface 272 of pad plate 234. Thus, the only contact between pad plate 234 and lower housing sections 253 is through columnar units 242. As noted above, upper bar members 244 are firmly attached to lower housing sections 253 and lower bar members 241 of columnar units 242 are firmly attached to pad plate 234. Thus, the only connection between lower housing sections 253 and pad plate 234 which can yield are plastic columns 243 which extend between lower bar members 241 and upper bar members 244 of columnar units 242.

The overall height of the orbital sander along its vertical centerline from the top of housing grip 232 to the underside of pad 233 is 98.33 millimeters. However, it will be appreciated that this dimension may be varied for other constructions of orbital sanders. Also, as noted above, the columnar units 242 need not be used with the specific low-height compressed air motor described above, but may be used with other types of motors.

The oscillatory motion of pad 233 is produced in the following manner. A bolt 273 extends through aperture 274 in pad plate 234 and is threadably received in spindle 275 which is retained with a press-fit in the inner races of the bearings 276 which are located in eccentric housing 229. A pin 279 (FIG. 23), which is fixedly mounted in bore 281 in spindle 271, extends through a bore 280 in pad plate 234 to prevent rotation of pad plate 234 as it is secured to spindle 275 by bolt 273 during assembly, and it also provides an orbital driving connection to the pad during sander operation. In the latter respect, as motor shaft 282 rotates, pin 281, bolt 273, and bearings 276 will be driven eccentrically relative to the axis of shaft 281 and thus pad plate 234 and pad 233 will be driven in an orbital motion. The foregoing connection is conventional in the art.

Figure 23:
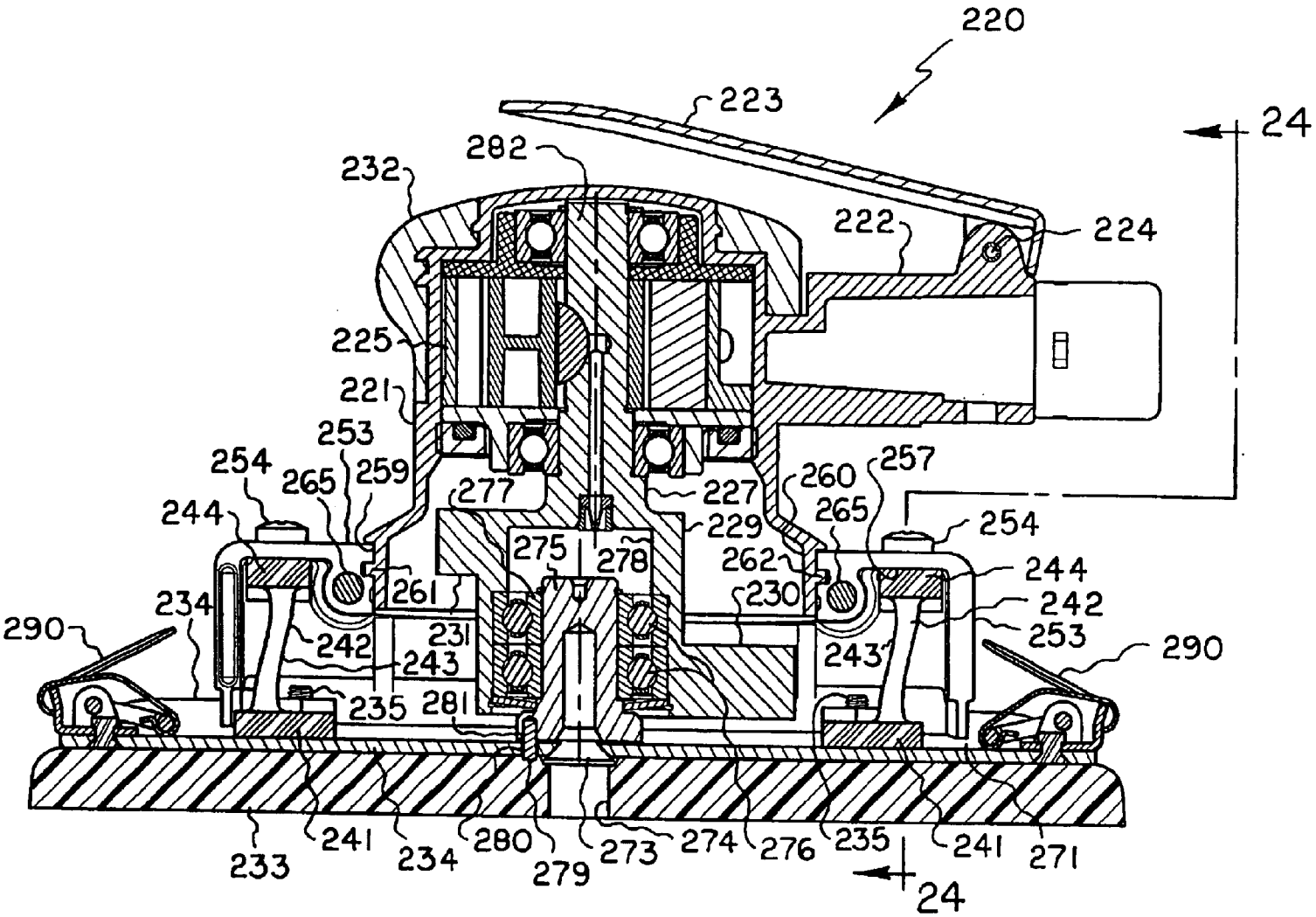
FIG. 23 is a cross sectional view taken substantially along line 23—23 of FIG. 22.
Figure 24:
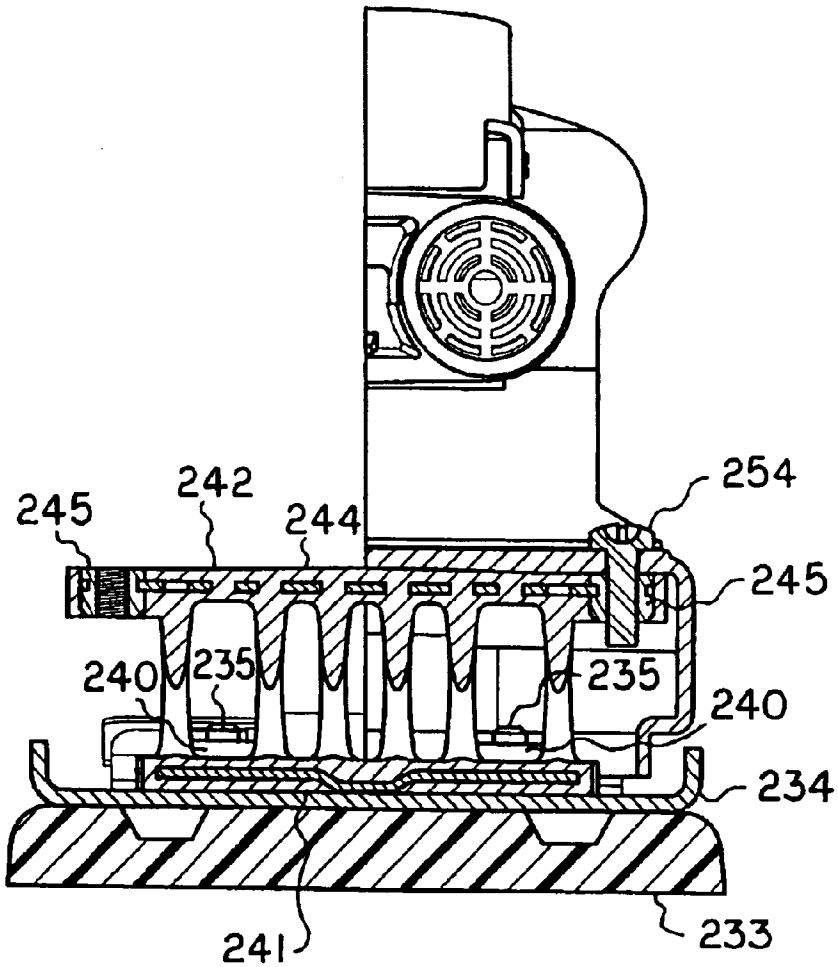
FIG. 24 is a cross sectional view taken substantially along line 24—24 of FIG. 23.
Figure 25:
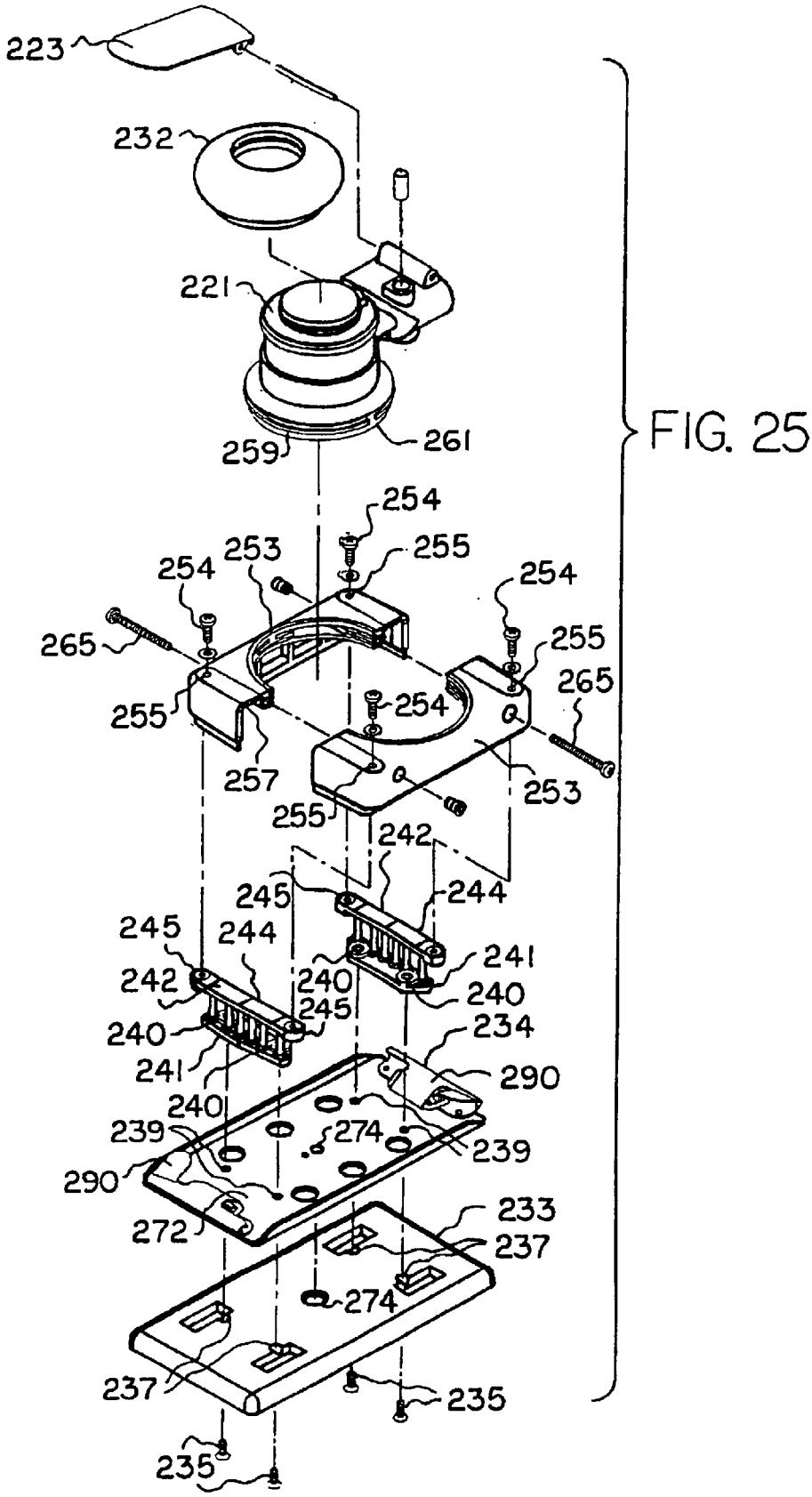
FIG. 25 is an exploded view of the orbital sander of FIGS. 22-24.
Figure 26:
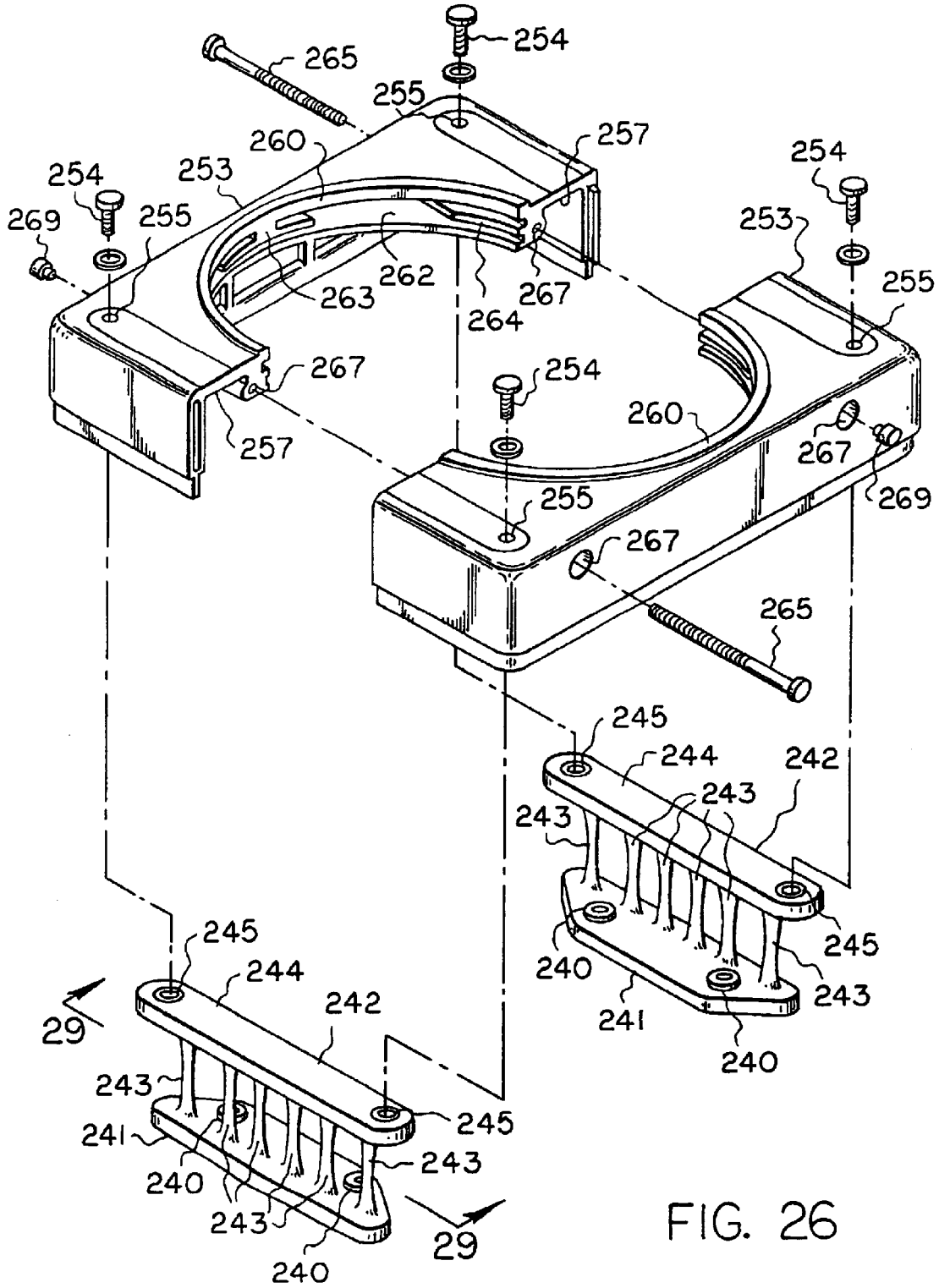
FIG. 26 is an enlarged exploded view of a portion of FIG. 25 showing the lower housing section and the columnar units which join the pad to the housing sections.

It can be seen from FIG. 23 that columns 243 are distorted and not perfectly symmetrical as shown in FIG. 28. This is due to the fact that when the pin 279 and bolt 273 secure the pad plate 234 to spindle 275, columns 243 will always be distorted. The reason they are perfectly symmetrical in FIG. 28 is because they are not shown in the position they assume when the pad plate 234 is connected to the spindle by bolt 273 and pin 279.

In FIG. 23 a duct arrangement is shown in shaft 282 for conducting compressed air to chamber 278 of eccentric housing 229. This duct arrangement may be identical to that described above relative to FIGS. 17-19 and may function in the same manner. Also, the arrangement for conducting compressed air to chamber 278 of eccentric housing 229 may also be the same as described above relative to FIGS. 20 and 21 and also as described above without being illustrated.

Conventional clips 290, which are well known in the art, are mounted at opposite ends of pad plate 272 for securing opposite ends of the sanding paper which extends across the pad 233.

While preferred embodiments of the present invention have been disclosed, it will be appreciated that it is not limited thereto but may be otherwise embodied within the scope of the following claims.

What is claimed is:

1. An orbital action surface-treating tool comprising a housing, a compressed air motor in said housing, a shaft in said motor, a rotor mounted on said shaft, compressed air ducts in said motor for conducting compressed air to said rotor, an eccentric housing mounted on said shaft, a chamber in said eccentric housing, at least one bearing in said eccentric housing, another duct in said shaft in communication with said compressed air ducts and said chamber for conducting compressed air to said chamber and to said at least one bearing in said chamber, a spindle mounted within said bearing, a pad, a backing on said pad, and a plurality of connections between said backing and said spindle.

2. An orbital action surface-treating tool as set forth in claim 1 including a one-way valve in said another duct for permitting flow from said another duct only into said chamber.

3. An orbital action surface-treating tool as set forth in claim 1 including a filter in said another duct.

4. An orbital action surface-treating tool as set forth in claim 1 wherein said another duct is a bore in said shaft, and including a keyway in said rotor, a key slot in said shaft, a key in said key slot and extending into said keyway, a clearance between said key and said key slot, a crossbore in said shaft in communication with said key slot, and said crossbore being in communication with said bore in said shaft.

5. An orbital action surface-treating tool as set forth in claim 4 including a pad having a face connected to said eccentric housing, and wherein said surface-treating tool has a vertical centerline, and wherein said surface-treating tool has a height dimension from the top of its housing to said face of said pad which is less than about 86 millimeters.

6. An orbital action surface-treating tool as set forth in claim 5 wherein said surface-treating tool has a weight of less than about 0.75 kilograms.

7. An orbital action surface-treating tool as set forth in claim 4 wherein said surface-treating tool has a weight of less than about 0.75 kilograms.

8. An orbital action surface-treating tool as set forth in claim 4 including a counterbore in said bore in communication with said chamber, and a one-way valve in said counterbore.

9. An orbital action surface-treating tool as set forth in claim 8 including a filter in said counterbore.

10. An orbital action surface-treating tool as set forth in claim 9 wherein said one-way valve is positioned between said filter and said chamber.

11. An orbital action surface-treating tool as set forth in claim 1 including an upper plate in said housing, an upper bearing in said upper plate supporting said shaft, a first clearance between said upper plate and said shaft, a second clearance between said shaft and said housing, and said another duct in said shaft being in communication with said first clearance through said upper bearing and said second clearance.

12. An orbital action surface-treating tool as set forth in claim 11 including a pad having a face connected to said eccentric housing, and wherein said surface-treating tool has a vertical centerline, and wherein said surface-treating tool has a height dimension from the top of its housing to said face of said pad which is less than about 86 millimeters.

13. An orbital action surface-treating tool as set forth in claim 11 wherein said surface-treating tool has a weight of less than about 0.75 kilograms.

14. An orbital action surface-treating tool as set forth in claim 11 wherein said surface-treating tool has a weight of less than about 0.75 kilograms.

15. An orbital action surface-treating tool as set forth in claim 11 wherein said another duct is a bore in said shaft, and including a counterbore in said bore in communication with said chamber, and a one-way valve in said counterbore.

16. An orbital action surface-treating tool as set forth in claim 15 including a filter in said counterbore.

17. An orbital action surface-treating tool as set forth in claim 16 wherein said one-way valve is positioned between said filter and said chamber.

18. An orbital action surface-treating tool as set forth in claim 1 including a pad having a face connected to said eccentric housing, and wherein said surface-treating tool has a vertical centerline, and wherein said surface-treating tool has a height dimension from the top of its housing to said face of said pad which is less than about 86 millimeters.

19. An orbital action surface-treating tool as set forth in claim 18 wherein said height dimension is about 83 millimeters.

20. An orbital action surface-treating tool as set forth in claim 18 wherein said surface-treating tool is a sander of the central vacuum type and wherein said dust discharge tube has a tube centerline, and wherein the horizontal distance between said vertical centerline and said outer end of said dust discharge tube at said tube centerline is between about 120 and 140 millimeters.

21. An orbital action surface-treating tool as set forth in claim 18 wherein said surface-treating tool is a sander of the self-generated vacuum type and wherein said dust discharge tube has a tube centerline, and wherein the horizontal distance between said vertical centerline and said outer end of said dust discharge tube at said tube centerline is between about 137 and 157 millimeters.

22. An orbital action surface-treating tool as set forth in claim 18 wherein said surface-treating tool has a weight of less than about 0.75 kilograms.

23. An orbital action surface-treating tool as set forth in claim 22 wherein said weight is about 0.68 kilograms.

24. An orbital action surface-treating tool as set forth in claim 22 wherein said surface-treating tool is a sander of the central vacuum type and wherein said dust discharge tube has a tube centerline, and wherein the horizontal distance between said vertical centerline and said outer end of said dust discharge tube at said tube centerline is between about 120 and 140 millimeters.

25. An orbital action surface-treating tool as set forth in claim 22 wherein said surface-treating tool is a sander of the self-generated vacuum type and wherein said dust discharge tube has a tube centerline, and wherein the horizontal distance between said vertical centerline and said outer end of said dust discharge tube at said tube centerline is between about 137 and 157 millimeters.

26. An orbital action surface-treating tool as set forth in claim 19 wherein said weight is about 0.68 kilograms.

27. An orbital action surface-treating tool as set forth in claim 19 wherein said surface-treating tool has a weight of less than about 0.75 kilograms.

28. An orbital action surface-treating tool as set forth in claim 1 wherein said surface-treating tool has a weight of less than about 0.75 kilograms.

29. An orbital action surface-treating tool as set forth in claim 1 wherein said weight is about 0.68 kilograms.

30. An orbital action surface-treating tool as set forth in claim 1 wherein said another duct is a slot in the outside of said shaft.

31. An orbital action surface-treating tool as set forth in claim 20 including a second bearing mounting said shaft, and wherein said slot is located adjacent said second bearing.

32. An orbital action surface-treating tool as set forth in claim 3 wherein said another duct is an inclined bore in said shaft.

33. An orbital action surface-treating tool comprising a housing, a compressed air motor in said housing, a shaft in said motor, a rotor mounted on said shaft, compressed air ducts in said motor for conducting compressed air to said rotor, an eccentric housing mounted on said shaft, a chamber in said eccentric housing, at least one bearing in said eccentric housing, ducts within said housing between said compressed air ducts and the side of said chamber proximate said rotor, a spindle mounted within said bearing, a pad, a backing on said pad, and a plurality of connections between said backing and said spindle.

34. An orbital action surface-treating tool as set forth in claim 33 including a pad having a face connected to said eccentric housing, and wherein said surface-treating tool has a vertical centerline, and wherein said surface-treating tool has a height dimension from the top of its housing to said face of said pad which is less than about 86 millimeters.

35. An orbital action surface-treating tool as set forth in claim 33 wherein said surface-treating tool has a weight of less than about 0.75 kilograms.

36. An orbital action surface-treating tool as set forth in claim 33 wherein said surface-treating tool has a weight of less than about 0.75 kilograms.

37. An orbital action surface-treating tool as set forth in claim 33, including a pad having a face connected to said eccentric housing, and wherein said surface-treating tool has a vertical centerline, and wherein said surface-treating tool has a height dimension from the top of its housing to said face of said pad which is between about 83 millimeters and 86 millimeters.

38. An orbital action surface-treating tool as set forth in claim 33 wherein said surface-treating tool has a weight of between about 68 kilograms and 75 kilograms.

39. An orbital action surface-treating tool as set forth in claim 33 wherein said surface-treating tool has a weight of between about 68 kilograms and 75 kilograms.

40. An orbital action surface-treating tool comprising a housing, a compressed air motor in said housing, a shaft in said motor, a rotor mounted on said shaft, compressed air ducts in said motor for conducting compressed air to said rotor, an eccentric housing mounted on said shaft, a chamber in said eccentric housing, at least one bearing in said eccentric housing, and another duct in said shaft in communication with said compressed air ducts and said chamber for conducting compressed air to said chamber and to said at least one bearing in said chamber.

41. An orbital action surface-treating tool comprising a housing, a compressed air motor in said housing, a shaft in said motor, a rotor mounted on said shaft, compressed air ducts in said motor for conducting compressed air to said rotor, an eccentric housing mounted on said shaft, a chamber in said eccentric housing, at least one bearing in said eccentric housing, and ducts within said housing between said compressed air ducts and the side of said chamber proximate said rotor.

* * * * *

UNITED STATES PATENT AND TRADEMARK OFFICE

CERTIFICATE OF CORRECTION

PATENT NO. : 6,855,040 B2
APPLICATION NO. : 10/373169
DATED : February 15, 2005
INVENTOR(S) : Paul W. Huber It is certified that error appears in the above-identified patent and that said Letters Patent is hereby corrected as shown below:

Column 18, Line 29, “68” and “75” should read --0.68-- and --0.75--, respectively.

Column 18, Line 32, “68” and “75” should read --0.68-- and --0.75--, respectively.

Signed and Sealed this
Fourth Day of October, 2011

David J. Kappos

David J. Kappos
*Director of the United States Patent and Trademark Office*